US011628460B2

(12) United States Patent
Piraino et al.

(10) Patent No.: US 11,628,460 B2
(45) Date of Patent: Apr. 18, 2023

(54) SPRAY GUN ALIGNMENT FOR PRECISION APPLICATION OF CONTAINER COATINGS

(71) Applicant: SWIMC LLC, Cleveland, OH (US)

(72) Inventors: Thomas P. Piraino, Cleveland, OH (US); Stephen W. Rozwood, Cleveland, OH (US)

(73) Assignee: SWIMC LLC, Cleveland, OH (US)

( * ) Notice: Subject to any disclaimer, the term of this patent is extended or adjusted under 35 U.S.C. 154(b) by 0 days.

(21) Appl. No.: 17/675,722

(22) Filed: Feb. 18, 2022

(65) Prior Publication Data

US 2022/0168768 A1 Jun. 2, 2022

Related U.S. Application Data

(63) Continuation of application No. PCT/US2021/040175, filed on Jul. 1, 2021.

(60) Provisional application No. 63/047,019, filed on Jul. 1, 2020.

(51) Int. Cl.

| | |
|---|---|
| ***B05B 13/02*** | (2006.01) |
| ***B05D 1/02*** | (2006.01) |
| ***B05D 7/22*** | (2006.01) |

(52) U.S. Cl.

CPC ..... *B05B 13/0278* (2013.01); *B05B 13/0242* (2013.01); *B05D 1/02* (2013.01); *B05D 7/227* (2013.01)

(58) Field of Classification Search

USPC ..... 118/DIG. 3

See application file for complete search history.

(56) References Cited

U.S. PATENT DOCUMENTS

| | | | | |
|---|---|---|---|---|
| 2,103,270 | A * | 12/1937 | Murch | B05B 13/0609 118/314 |
| 4,180,844 | A * | 12/1979 | Peck | B05B 5/12 427/478 |
| 5,393,346 | A * | 2/1995 | Cholewa | B05B 13/0257 427/242 |
| 2016/0368013 | A1 | 12/2016 | Okada et al. | |
| 2018/0133735 | A1 | 5/2018 | Wilkinson | |

FOREIGN PATENT DOCUMENTS

| | | | |
|---|---|---|---|
| CN | 1956798 | A | 5/2007 |
| CN | 104220175 | A | 12/2014 |
| CN | 205926137 | U | 2/2017 |

(Continued)

OTHER PUBLICATIONS

PCT International Search Report for PCT Application No. PCT/US2021/040175 dated Oct. 26, 2021 (3 pages).

(Continued)

*Primary Examiner* — Charles Capozzi
(74) *Attorney, Agent, or Firm* — Merchant & Gould P.C.

(57) ABSTRACT

A spray gun alignment system precisely aligns a spray gun of a container spray machine for precision application of container coatings. The spray gun alignment system generates a spray gun alignment jig including a container holder adapter and a spray gun adapter. The container holder adapter is inserted into a container holder of the spray machine, and the spray gun adapter is fastened to the spray gun. The spray gun alignment jig is configured to position the spray gun in proper alignment with respect to the container holder.

25 Claims, 25 Drawing Sheets

(56) References Cited

FOREIGN PATENT DOCUMENTS

| | | | |
|---|---|---|---|
| CN | 205995685 | U | 3/2017 |
| CN | 106794482 | A | 5/2017 |
| JP | S62-294461 | A | 12/1987 |
| JP | 2003039261 | A | 2/2003 |
| JP | 2014240040 | A | 12/2014 |
| WO | 2022/006450 | A1 | 1/2022 |

OTHER PUBLICATIONS

PCT Written Opinion for PCT Application No. PCT/US2021/040175 dated Oct. 26, 2021 (3 pages).

* cited by examiner

108

SPRAY GUN ALIGNMENT FOR PRECISION APPLICATION OF CONTAINER COATINGS

CROSS-REFERENCE TO RELATED APPLICATIONS

This application is a continuation of PCT International Patent Application No. PCT/US2021/040175, filed Jul. 1, 2021, which claims the benefit of and priority to U.S. Provisional Patent Application No. 63/047,019 filed on Jul. 1, 2020, the disclosures of which are hereby incorporated by reference in their entireties.

BACKGROUND

It is often beneficial to apply coatings to containers. For example, aluminum food and beverage cans are coated on interior surfaces with a liner that forms a protective barrier between the food or beverage product and the metal. Similarly, coatings are also commonly applied to other types of containers for storage of products other than food and beverages.

Spray machines can rapidly and effectively apply coatings to containers by spraying the coating using a spray gun, but the alignment between the spray gun and the container is critical to forming a proper protective barrier. Even a small misalignment of the spray gun can result in improper application, and therefore highly skilled operators are required to properly align the spray gun. To further complicate matters, different coatings require different spray gun setups, and therefore the alignment must be reconfigured each time a different coating is introduced.

Spray machines are also used in other applications, such as for spraying general industrial liquids (e.g. for metal cabinets, machine parts, appliances), industrial wood coatings and treatments (e.g. for kitchen cabinets and furniture), powder coatings, and in automotive interiors.

SUMMARY

In general terms, this disclosure is directed to spray gun alignment. In one possible configuration and by non-limiting example, a spray gun is aligned for precision application of liquid or power container coatings. Various aspects are described in this disclosure, which include, but are not limited to, the following aspects.

One aspect is a spray gun alignment jig for aligning a spray gun with a container holder of a container spray machine, the spray gun alignment jig comprising: a container holder adapter that engages with a container holder of the container spray machine; a spray gun adapter that engages with the spray gun; and a linkage that connects the spray gun adapter and the container holder adapter in a predetermined alignment.

Another aspect is the spray gun alignment jig, wherein the linkage includes a releasable joint that is releasable to separate the container holder adapter from the spray gun adapter.

A further aspect is the spray gun alignment jig, wherein the container holder adapter is sized to fit within the container holder of the container spray machine and further comprises an orientation guide that causes the container holder adapter to fit within the container holder in a particular orientation.

Yet another aspect is the spray gun alignment jig, wherein the container holder is part of a container spinner of a container transporter of the container spray machine.

Another aspect is the spray gun alignment jig, wherein the spray gun adapter includes a tip alignment receptacle that receives the tip of the spray gun to align the spray gun adapter with the tip of the spray gun.

A further aspect is the spray gun alignment jig, wherein the predetermined alignment includes a predetermined position and a predetermined orientation.

Yet another aspect is the spray gun alignment jig, wherein the predetermined position comprises: a forward/backward position; a left/right position; and an up/down position.

Another aspect is the spray gun alignment jig, wherein the predetermined orientation comprises: a pitch; a roll; and a yaw.

A further aspect is the spray gun alignment jig, wherein the predetermined alignment causes the spray gun to spray an interior coating that conforms to at least one interior coating criterion.

Yet another aspect is the spray gun alignment jig, wherein the at least one interior coating criterion is selected from: an amount of an interior surface that is coated, a thickness of the interior coating, an amount of interior surface that is exposed, and an electrical resistance of the interior coating.

Another aspect is the spray gun alignment jig that is configured to align the spray gun with the container in a predetermined orientation selected for applying an interior coating to the container, the interior coating being one of: a sprayable water-borne coating composition, a sprayable organic-solvent-based coating composition, and a sprayable powder coating composition.

A further aspect is the spray gun alignment jig, wherein the interior coating further comprises one or more film-forming components selected from: latex emulsions, organic solution polymerized acrylic polymers, polyester polymers, polyether polymers, polyether-acrylate polymers, polyester-acrylate polymers, polyolefin polymers, and copolymers and combinations thereof.

Yet another aspect is the spray gun alignment jig, wherein the spray gun alignment jig is configured to align the spray gun based on at least one coating characteristic selected from a viscosity of the coating, a rheology of the coating, and a draping of the coating.

Another aspect is the spray gun alignment jig that is configured to align the spray gun with a container holder to spray a coating selected from the group consisting of: an INNOVEL HPS series of water-borne acrylic beverage can inside spray product; an INNOVEL MAX internal spray lacquer product; an INNOVEL VCL clear internal spray product; a NUTRISHEILD SOLISTA non-BPA internal spray product; a PPG6100 internal gold and aluminized spray coating product; a PPG 6150 internal gold and aluminized spray coating product; an AQUALURE G1 50 beverage can inside spray product; a VALPURE acrylic and polyether-acrylic beverage can inside spray non-BPA product; a VALPURE polyether-acrylic and polyester two-piece D&I food can inside spray non-BPA product; a CANVERA 1110 beverage can inside spray product; and a CANVERA 3110 food can internal spray product.

Another aspect is a method of aligning a spray gun of a container spray machine, the container spray machine having a container holder for holding a container during spraying, the method comprising: arranging a container holder adapter of a spray gun alignment jig onto the container holder; arranging a spray gun adapter onto the spray gun; and aligning the spray gun with respect to the container holder as indicated by the spray gun alignment jig.

A further aspect is a method of aligning the spray gun, further comprising generating the spray gun alignment jig by: generating a three-dimensional model of the container holder adapter, a configuration of the container holder adapter being selected to engage with the container holder of the container spray machine; generating a three-dimensional model of the spray gun adapter, a configuration of the spray gun adapter being selected to engage with the spray gun of the container spray machine; generating a three-dimensional model of a linkage that extends between the container holder adapter and the spray gun adapter to arrange the spray gun adapter in a predetermined alignment with respect to the container holder adapter; and using the three-dimensional models of the container holder adapter, spray gun adapter, and linkage to generate the spray gun alignment jig having the container holder adapter, spray gun adapter, and linkage.

Another aspect is the method of aligning the spray gun, further comprising: applying a coating to the container after aligning the spray gun of the container spray machine.

Yet another aspect is the method of aligning the spray gun, wherein the alignment is selected for spraying a coating comprising at least one of: a sprayable water-borne coating composition, a sprayable organic-solvent-based coating composition, and a sprayable powder coating composition.

A further aspect is the method of aligning the spray gun, wherein the alignment is selected for spraying a coating selected from the group consisting of: an INNOVEL HPS series of water-borne acrylic beverage can inside spray product; an INNOVEL MAX internal spray lacquer product; an INNOVEL VCL clear internal spray product; a NUTRISHEILD SOLISTA non-BPA internal spray product; a PPG6100 internal gold and aluminized spray coating product; a PPG 6150 internal gold and aluminized spray coating product; an AQUALURE G1 50 beverage can inside spray product; a VALPURE acrylic and polyether-acrylic beverage can inside spray non-BPA product; a VALPURE polyether-acrylic and polyester two-piece D&I food can inside spray non-BPA product; a CANVERA 1110 beverage can inside spray product; and a CANVERA 3110 food can internal spray product.

Yet another aspect is a method of generating a spray gun alignment jig for aligning a spray gun of a container spray machine, the method comprising: generating a three-dimensional model of a container holder adapter, a configuration of the container holder adapter being selected to engage with a container holder of the container spray machine; generating a three-dimensional model of a spray gun adapter, a configuration of the spray gun adapter being selected to engage with the spray gun of the container spray machine; generating a three-dimensional model of a linkage that extends between the container holder adapter and the spray gun adapter to arrange the spray gun adapter in a predetermined alignment with respect to the container holder adapter; and using the three-dimensional models of the container holder adapter, spray gun adapter, and linkage to generate the spray gun alignment jig having the container holder adapter, spray gun adapter, and linkage.

Another aspect is the method of generating a spray gun alignment jig, wherein using the three-dimensional models to generate the spray gun alignment jig comprises sending instructions to a 3D printer.

A further aspect is the method of generating a spray gun alignment jig, wherein generating the spray gun alignment jig comprises printing the spray gun alignment jig with a 3D printer.

Another aspect is the method of generating a spray gun alignment jig, further comprising: receiving input from a user defining predetermined measurements between the spray gun and the container holder; and using the input to generate the three-dimensional model of the linkage with the predetermined alignment.

Yet another aspect is the method of generating a spray gun alignment jig, further comprising: receiving a selection of a coating or type of coating to be applied to a container by the container spray machine; selecting from a database measurements identifying the predetermined alignment based on the coating or type of coating; and using the measurements to generate the three-dimensional model of the linkage with the predetermined alignment.

A further aspect is the method of generating a spray gun alignment jig, wherein the spray gun alignment jig is configured to align the spray gun of the container spray machine to spray a coating comprising at least one of: a sprayable water-borne coating composition, a sprayable organic-solvent-based coating composition, and a sprayable powder coating composition.

Another aspect is the method of generating a spray gun alignment jig, wherein the spray gun alignment jig is configured to align the spray gun of the container spray machine to spray a coating selected from the group consisting of: an INNOVEL HPS series of water-borne acrylic beverage can inside spray product; an INNOVEL MAX internal spray lacquer product; an INNOVEL VCL clear internal spray product; a NUTRISHEILD SOLISTA non-BPA internal spray product; a PPG6100 internal gold and aluminized spray coating product; a PPG 6150 internal gold and aluminized spray coating product; an AQUALURE G1 50 beverage can inside spray product; a VALPURE acrylic and polyether-acrylic beverage can inside spray non-BPA product; a VALPURE polyether-acrylic and polyester two-piece D&I food can inside spray non-BPA product; a CANVERA 1110 beverage can inside spray product; and a CANVERA 3110 food can internal spray product.

A further aspect is at least one computer readable storage device storing data instructions that, when executed by at least one processing device, cause the at least one processing device to perform operations comprising: receive input identifying a predetermined alignment of a spray gun with respect to a container holder of a container spray machine; and generate a three-dimensional model of a spray gun alignment jig comprising: a container holder adapter that engages with a container holder of the container spray machine; a spray gun adapter that engages with the spray gun; and a linkage that connects the spray gun adapter to the container holder adapter with the predetermined alignment.

Another aspect is the at least one computer readable storage device, wherein the instructions further cause the at least one processing device to: receive input identifying a spray gun type; and generate the three-dimensional model of the spray gun adapter based on the spray gun type.

Yet another aspect is the at least one computer readable storage device, wherein the instructions further cause the at least one processing device to: receive input identifying a container spray machine type; and generate the three-dimensional model of the container holder adapter based on the container spray machine type.

A further aspect is the at least one computer readable storage device, wherein the instructions further cause the at least one processing device to: generate the three-dimensional model of the linkage, wherein the linkage includes a body, the body being sized and shaped to connect the three-dimensional model of the container holder adapter to the three-dimensional model of the spray gun.

Another aspect is the at least one computer readable storage device, wherein generating the three-dimensional model of the linkage further comprises defining the size and shape of the body to avoid interference with components of the container spray machine based on the container spray machine type.

DETAILED DESCRIPTION

Figure 1:
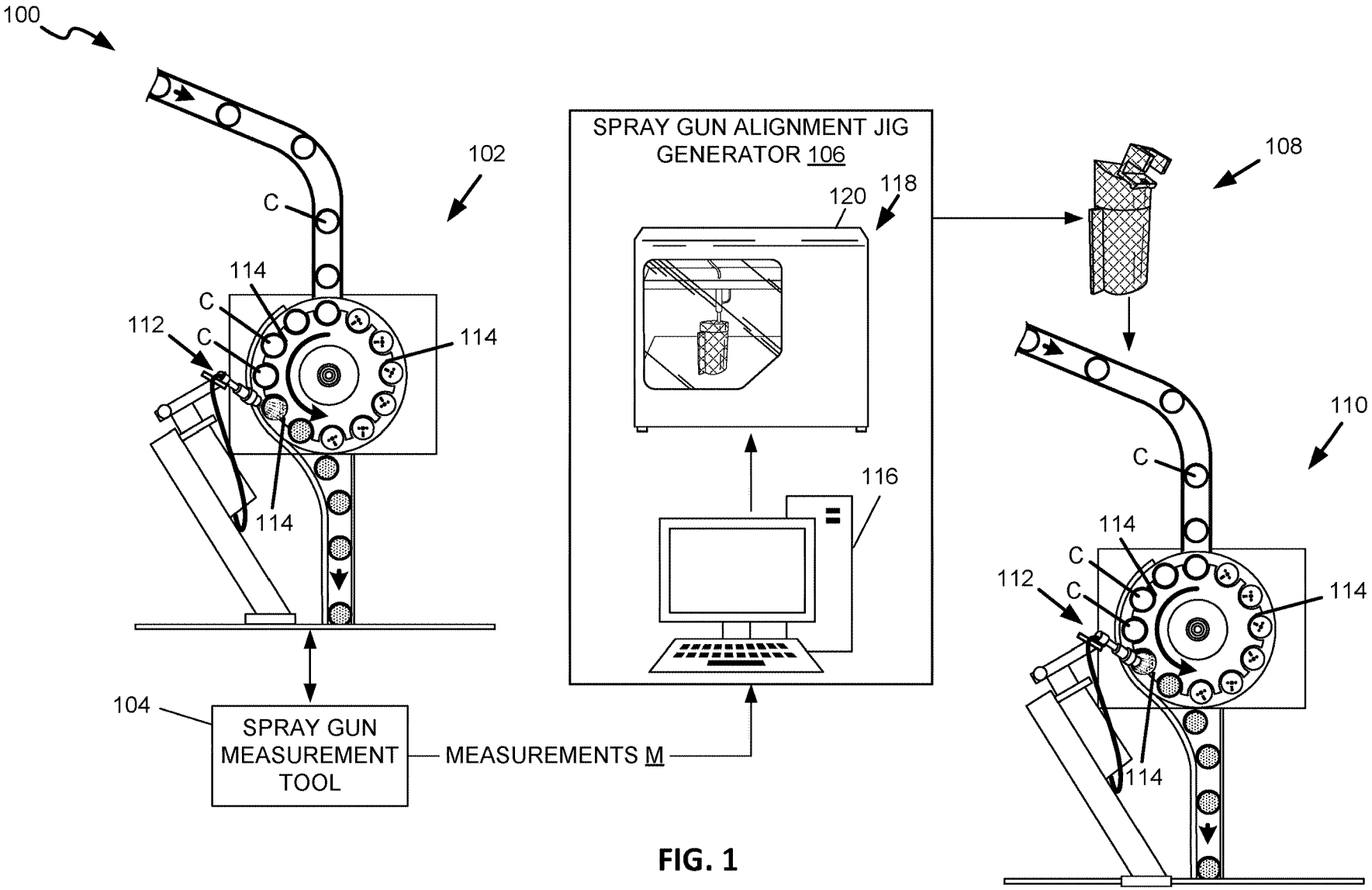
FIG. 1 is a schematic block diagram of an example spray gun alignment system according to the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a schematic block diagram of an example spray gun alignment system 100. In the illustrated example, the spray gun alignment system 100 includes a lab spray machine 102, a spray gun measurement tool 104, an alignment jig generator 106, a spray gun alignment jig 108, and a field spray machine 110. The example lab spray machine 102 and field spray machine 110 both include a spray gun 112 and a container holder 114. The example alignment jig generator 106 includes a computing device 116 and a jig fabrication machine 118, such as a 3D printer 120. Containers C are also shown.

The spray gun alignment system 100 operates to properly align the spray gun 112 of the field spray machine 110 with respect to a container C and container holder 114, so that the spray machine 110 can precisely apply a coating to the container C. It does so by generating a spray gun alignment jig 108 that is sized and configured to guide the precise alignment of the spray gun 112 of the field spray machine 110. An example method of operating the spray gun alignment system 100 is illustrated and described in further detail herein with reference to FIG. 2.

In the example shown in FIG. 1, the spray gun alignment system 100 includes a plurality of spray machines, including a lab spray machine 102 and a field spray machine 110. The spray machines 102 and 110 can be of the same or a similar type having the same or similar configuration. Accordingly, in this disclosure similar components of the lab spray machine 102 and the field spray machine 110 share common names and reference numbers. Examples of the spray machines 102 and 110 are illustrated and described in further detail herein with reference to FIGS. 3-4.

It is beneficial for there to be a separate lab spray machine 102 that can be used by operators without having to stop or slow down production of the field spray machine 110. As one example, the field spray machine 110 may be located in a facility where a large volume of containers C are processed. The lab spray machine 102 can be located in a different room or facility, such as a laboratory space or a pilot plant space. Operators can interact with the lab spray machine 102 without having to interfere with the field spray machine's 110 processing of containers C. In this way, the field spray machine 110 may continue operating to process containers C while operators interact with the lab spray machine 102. However, it is not required to have separate lab and field spray machines 102 and 110, and in some embodiments the spray gun alignment system 100 includes only the field spray machine 110 without a separate lab spray machine 102.

Operators can use the lab spray machine 102 (or field spray machine 110) to determine an optimal alignment between the spray gun 112 and the container C (and container holder 114, where the container C is held) for spraying a particular liquid coating composition, which is typically a liquid or powder coating composition, more typically a liquid coating composition (e.g., a water-based or solvent-based coating composition). The operators can arrange the spray gun 112 in a first alignment, and then run tests by spraying the coating composition onto containers C from that first alignment. A cured coating resulting from the coating composition can then be tested to check the properties of the coating, and to determine whether the coating satisfies one or more predetermined criteria. For sake of convenience, in the discussions that follow an uncured coating composition (e.g., a liquid or powder coating composition) yet to be applied to a container, an uncured coating formed therefrom on a container, and a cured coating formed on the container (e.g., after thermal bake of the applied coating), are all referred to as a "coating" or "coatings." If the coating composition is not properly applied to the container, adjustments can be made to arrange the spray gun 112 in a second alignment. Testing can continue in this manner until the optimal alignment between the spray gun 112 and the container (and container holder 114) is identified, and the testing shows that the coating criteria are satisfied.

Once the spray gun 112 is properly positioned with respect to the container C and container holder 114, one or more spray gun measurement tools 104 can then be used to measure or otherwise identify the proper alignment. A variety of spray gun measurement tools 104 can be used to determine the alignment of the spray gun 112, such as rulers, calipers, laser measurement tools, protractors, scanners, and the like.

In some embodiments the alignment of the spray gun 112 includes both a position and an orientation of the spray gun 112. Typically, the position and orientation are determined relative to the position and orientation of the container C or container holder 114, but it can also be determined relative to another portion of the spray machine 102, 110 or another object. The position of the spray gun can be determined for a particular point of the spray gun 112, such as a tip of a spray nozzle, and the point can be measured in three-dimensions, such as in X, Y, Z coordinates. In some embodiments the position includes: a forward/backward position, a left/right position, and an up/down position. The orientation defines the direction that the spray gun is pointing. In some embodiments the orientation comprises at least one of a pitch, a roll, and a yaw. An example of the spray gun alignment is illustrated and described in further detail herein with reference to FIG. 5.

In some embodiments the spray gun alignment system 100 includes a spray gun alignment jig generator 106. In the illustrated example, the spray gun alignment jig generator 106 includes a computing device 116 and a jig fabrication machine 118. The alignment jig generator 106 operates to generate the spray gun alignment jig 108. Examples of the spray gun alignment jig generator 106 are illustrated and described in more detail herein with reference to FIGS. 7-20.

In some embodiments the spray gun alignment jig generator 106 receives the measurements M that define the alignment of a spray gun 112, and operates to generate the spray gun alignment jig 108.

In some embodiments the measurements M define the position and orientation of the spray gun 112, as discussed above. The measurements M can be received by the spray gun alignment jig generator 106 in various ways, such as by being input into the computing device 116 by an operator, or by transmission to the computing device 116 from another computing device (such as through one or more data communication networks). In another possible embodiment, the measurements M can be stored in a database, and the computing device 116 can be used to retrieve the measurements from the database.

The computing device 116 operates to generate a three-dimensional model of a spray gun alignment jig 108. After the three-dimensional model has been defined, it is then used to generate and send instructions for the fabrication of the spray gun alignment jig 108 to a jig fabrication machine 118, such as the 3D printer 120.

The jig fabrication machine 118 includes one or more machines that operate to fabricate the spray gun alignment jig based on the three-dimensional model defined by the computing device 116.

One example of the jig fabrication machine 118 is a 3D printer 120. The 3D printer 120 is a machine that builds the spray gun alignment jig 108 using an additive manufacturing process. In the additive manufacturing process one or more materials are successively added layer by layer according to the three-dimensional model.

Another example of the jig fabrication machine 118 is a mill, such as a computer numerical control ("CNC") router. In yet other embodiments, the jig fabrication machine can include one or more of these or other machines and manufacturing processes.

The spray gun alignment jig 108 is a tool that can be used to properly align the spray gun 112 of the field spray machine 110. For example, a portion of the spray gun alignment jig 108 can be inserted into the container holder 114 of the field spray machine 110. Another portion of the spray gun alignment jig 108 can be fastened to the spray gun 112. The spray gun alignment jig 108 can then be used to guide the repositioning of the spray gun 112 so that it is properly aligned. Once alignment has been completed, the spray gun alignment jig 108 can then be removed from the field spray machine 110. Using the spray gun alignment jig 108, the alignment of the spray gun 112 can be accomplished quickly and accurately. As a result, downtime of the field spray machine 110 can be greatly reduced, and the quality of the coating applied to the container is improved. Once properly aligned, the spray gun 112 will apply the coating onto the container C such that the coating has characteristics that satisfy one or more predetermined criteria.

Figure 2:
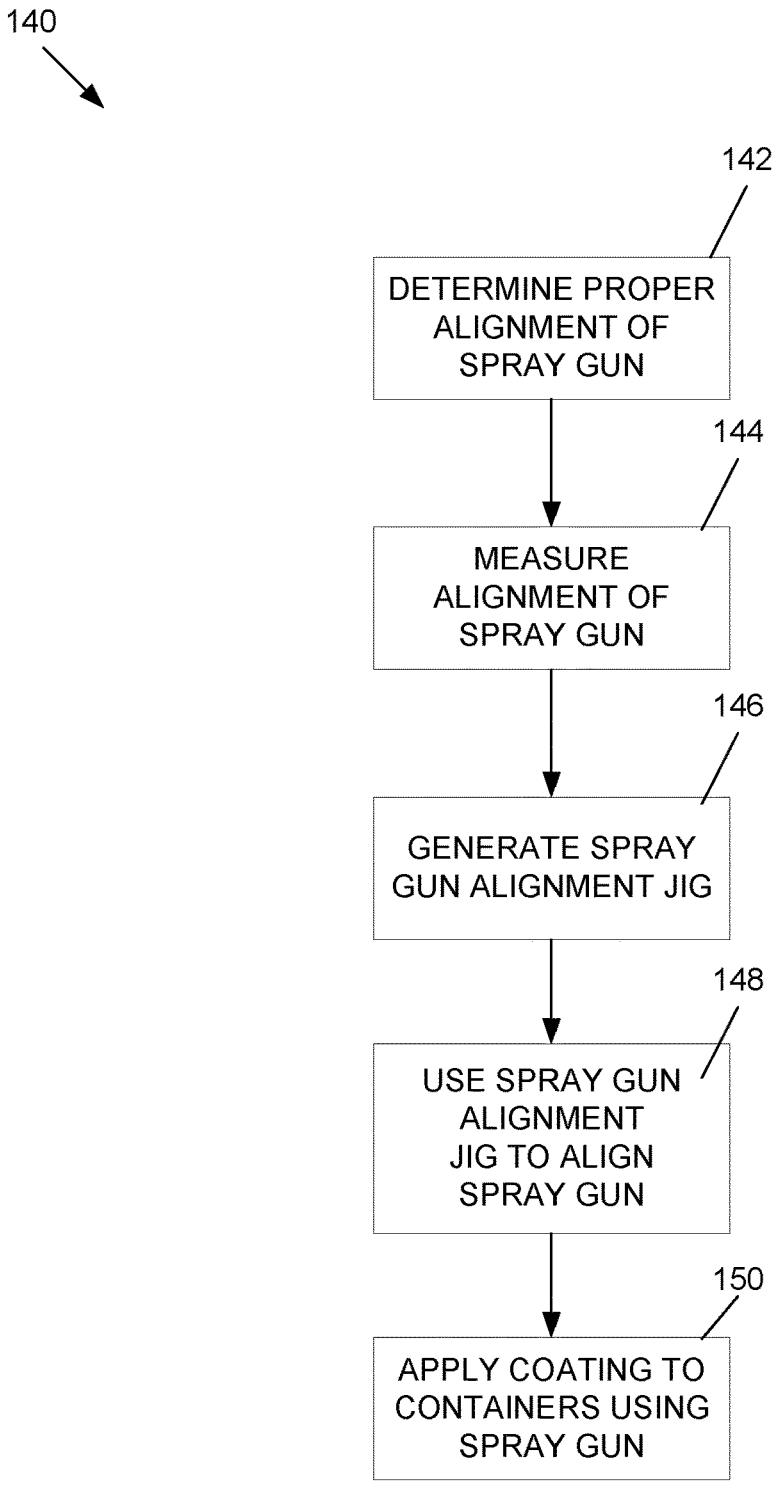
FIG. 2 is a flow chart illustrating an example method of aligning a spray gun of a container spray machine.

FIG. 2 is a flow chart illustrating an example method 140 of aligning a spray gun of a container spray machine. In this example, the method 140 includes operations 142, 144, 146, 148, and 150. Method 140 is also an example of a method of applying a coating to a container.

The operation 142 is performed to determine a proper alignment of a spray gun 112. For example, a lab spray machine 102, shown in FIG. 1, can be used to determine an alignment of the spray gun 112 that will spray a coating onto a container C to generate a coating having certain characteristics. Adjustments can be made to the alignment of the spray gun 112 until the proper alignment is achieved. Examples of the operation and alignment of the spray gun are illustrated and described in further detail herein with reference to FIGS. 3-4.

Once the proper alignment has been identified, operation 144 is performed to measure the alignment of the spray gun 112. An example of the measurement of the spray gun 112 alignment is illustrated and described in further detail herein with reference to FIG. 5.

The operation 146 is performed to generate a spray gun alignment jig 108 based on the measurements. Examples of the generation of a spray gun alignment jig 108 are illustrated and described in further detail herein with reference to FIGS. 7-21.

The operation 148 is performed to align a spray gun 112 using the spray gun alignment jig 108. For example, the spray gun alignment jig 108, shown in FIG. 1, can be used in the field spray machine 110 to align the spray gun 112.

Once aligned, the operation 150 is then performed to apply a coating to containers C using the spray gun 112.

Figure 3:
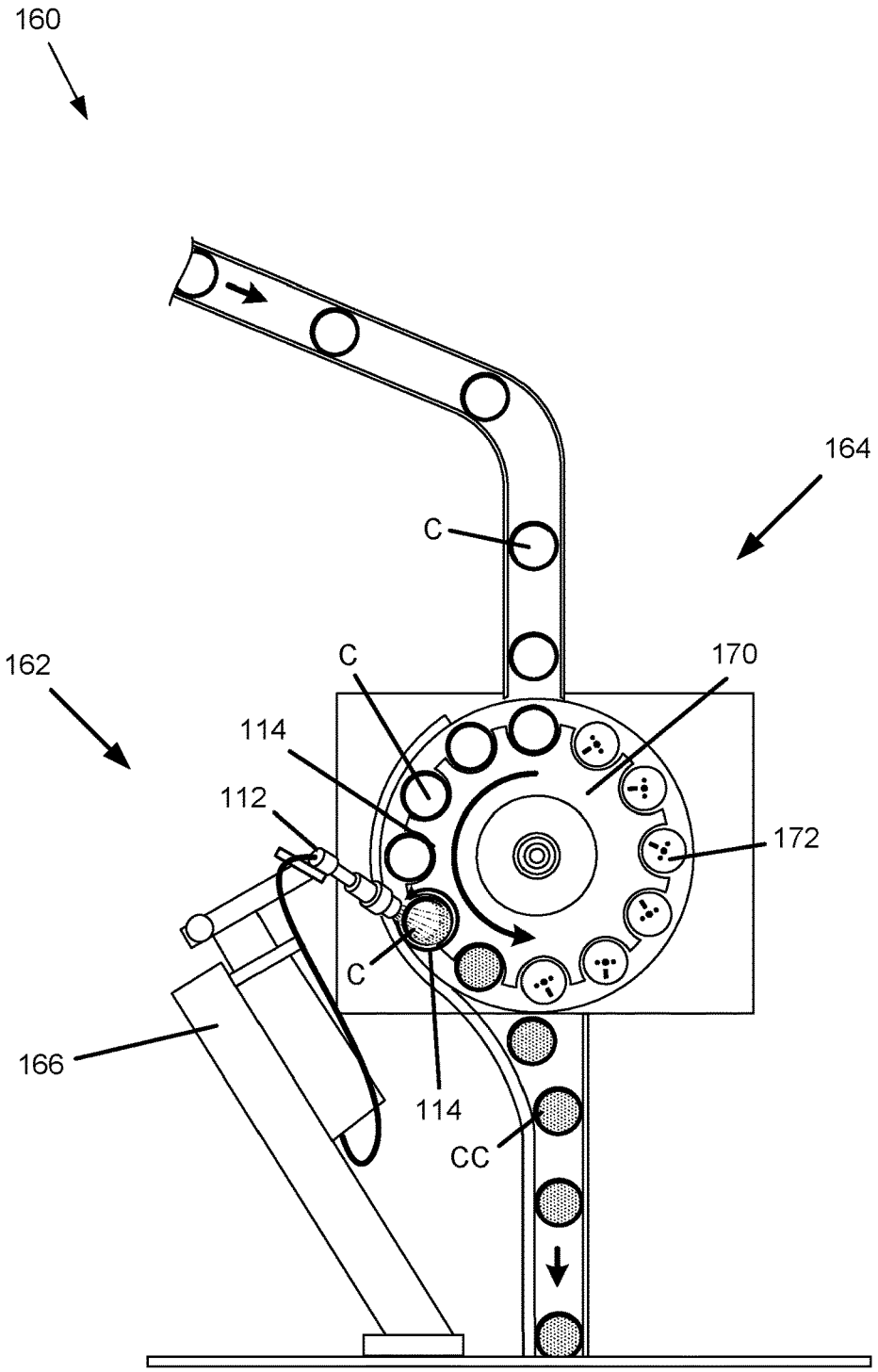
FIG. 3 is a schematic diagram illustrating an example of a spray machine of the system shown in FIG. 1.

FIG. 3 is a schematic diagram illustrating an example of a spray machine 160. The spray machine 160 is an example of the laboratory spray machine 102, and is also an example of the field spray machine 110, both of which are illustrated in FIG. 1. In this example, the spray machine 160 includes a spray assembly 162 and a container transporter 164. The example spray assembly 162 includes a spray gun 112 and an adjustable gun mount 166. The example container transporter 164 includes a turret 170, container holders 114, and spinners 172. Containers C and coated containers CC are also illustrated.

The spray assembly 162 includes components of the spray machine 160 that cooperate to spray a coating onto the containers C. In this example, the spray assembly 162 includes an adjustable gun mount 166 which adjustably secures the spray gun 112 to the spray machine 160. The adjustable gun mount 166 includes an adjustable frame structure that securely supports the spray gun 112, but also allows the alignment of the spray gun 112 to be adjusted and repositioned by an operator. Once the alignment of the spray gun 112 is adjusted, the adjustable gun mount 166 securely holds the spray gun 112 in that alignment during operation of the spray machine 160.

The container transporter 164 operates to support and transport containers C through the spray machine 160. In various embodiments, the spray machine 160 can have a variety of container transport mechanisms to move containers C through the spray machine 160. In this example, the container transporter 164 includes a rotating turret 170. The turret 170 includes a plurality of container holders 114 that are configured to securely hold the containers C at container positions defined by the container holders 114. In this example, the turret 170 includes a plurality of container holders 114 arranged about a periphery of the turret 170. In some embodiments, the container transporter 164 also includes one or more spinners 172. The spinner 172 operates to rotate the container C during at least a portion of the spraying process. In some embodiments, the spinner 172 is part of the container holder 114. In some embodiments, the spinner 172 includes a can fastening mechanism, to temporarily fasten the container C to the spinner 172. For example, in some embodiments the spinner 172 includes one or more magnets (such as electromagnets). In another example, the spinner 172 includes a vacuum fastener. The container transporter 164 operates to transport containers C through the spray machine 160, and specifically to move the containers using the container holder 114 into a spray position directly adjacent to the spray gun 112. When the container C is in the spray position, the spray gun 112 is activated to spray a coating onto the container C. The coating may be applied to an interior or exterior of the container C, and in the illustrated example is applied to the interior. In some embodiments the spinner 172 operates to spin the container C during and/or after the spraying of the coating by the spray gun 112. The spinner 172 operates to distribute the spray pattern along the surfaces of the container C so that the coating is evenly applied, and can also be used to distribute the coating after it has been applied to the container. For example, the spinner 172 spins the container to generate a centrifugal force on the container and on the coating that further distributes the coating along the container C surfaces. The container transporter 164 then advances the coated container CC out from the spray position and out of the spray machine 160.

In some embodiments, the spray machine 160 includes a plurality of spray guns 112. For example, in some embodiments the spray machine 160 includes two or more spray positions, and spray guns 112 are arranged at each of the spray positions. This can be useful for spraying multiple containers at once, or for the application of multiple different coatings (one by each spray gun 112).

Figure 4:
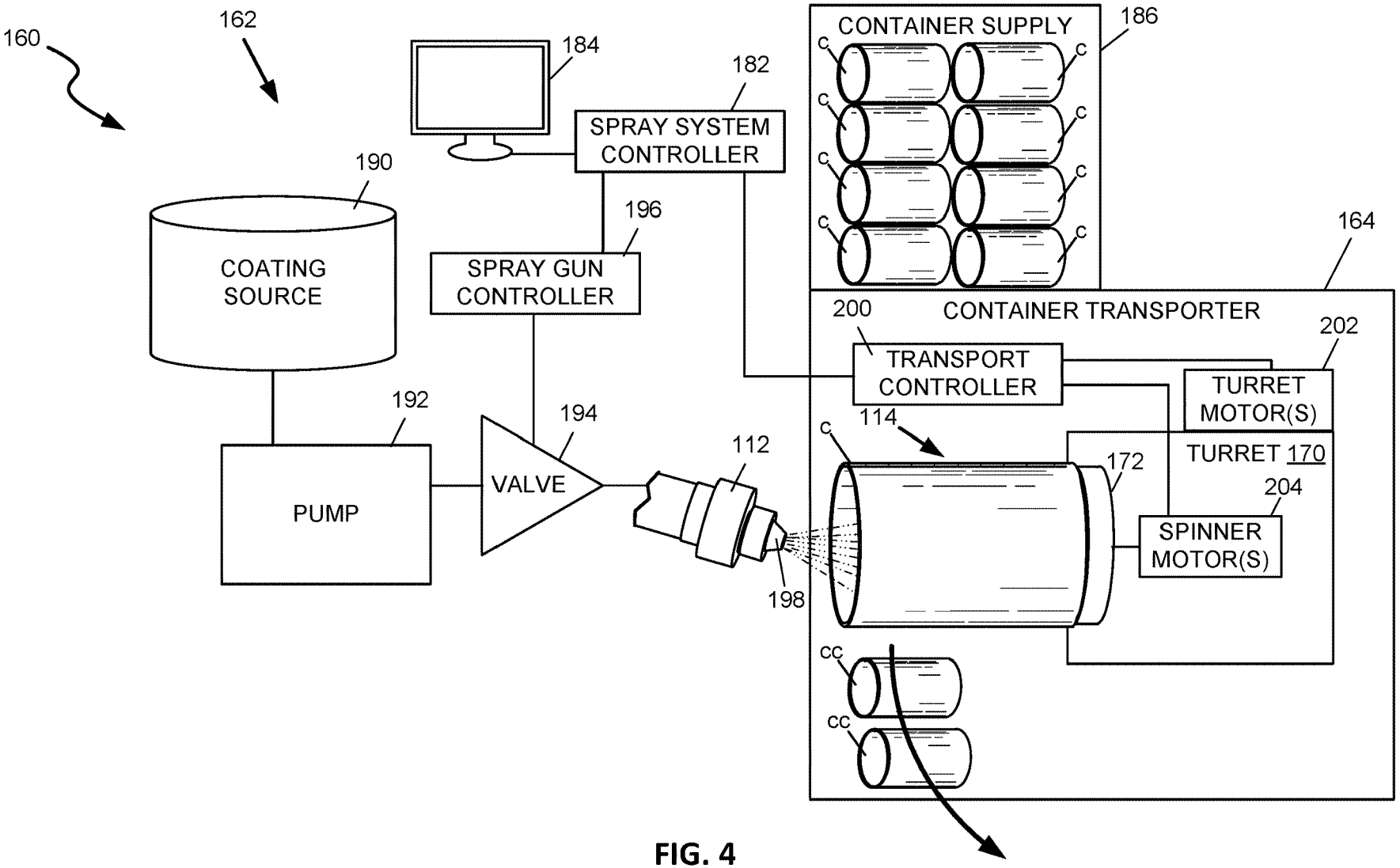
FIG. 4 illustrates another example of the spray machine shown in FIG. 3.

FIG. 4 illustrates another example of the spray machine 160, shown in FIG. 3. In this example, the example spray machine 160 includes the spray assembly 162, the container transporter 164, a spray system controller 182 with a control interface 184, and a container supply 186. The example spray assembly 162 includes a coating source 190, a pump 192, a valve 194, the spray gun 112, and a spray gun controller 196. The example spray gun 112 includes a nozzle 198. The example container transporter 164 includes a transport controller 200, a turret motor 202, a turret 170, a spinner motor 204, and the spinner 172. The containers C and coated containers CC are also illustrated.

In this example, the spray machine 160 includes a container supply 186 which stores the containers C to be coated by the spray machine 160. The spray machine 160 also includes a coating source 190, which stores the coating to be applied to the containers. The containers C are transported through the spray machine 160 by the container transporter 164, and are sprayed by the spray assembly 162.

The coating source 190 typically includes a receptacle that stores the coating to be applied to the container C. An example of a possible receptacle is a hopper. In some embodiments the spray machine 160 includes a plurality of coating sources 190, each of which contain different coatings or different types of coatings. Typically, the coatings in the coating source(s) are liquid coatings such as solvent-based or water-based coatings, more typically water-based coatings. The coating source 190 is in fluid communication with the valve 194, such as through one or more conduits.

The spray assembly 162 also includes one or more pumps 192 that operate to advance the coating from the coating source 190 through the valve 194 and to the spray gun 112. One example of the pump 192 is a piston pump that cooperates with a set of valves to draw transport the coating, through one or more conduits, from the coating source 190 and to the valve 194. Some sprayers that utilize a fluid pump to pump the coating are referred to as "airless sprayers." Another example of a pump 192 is a compressor which generates compressed air that is usable by the spray gun 112 to advance the coating from the coating source 190. Compressed air can also be used in some embodiments to pressurize the reservoir of the coating source 190 to advance the coating from the coating source.

The valve 194 is controlled by the spray gun controller 196 and selectively opens or closes a passageway through which the coating (and in an air sprayer, the compressed air) is delivered to the spray gun 112. In some embodiments the valve 194 is part of the spray gun 112.

The spray gun 112 receives the coating from the valve 194 and sprays the coating onto the container C from the nozzle 198. In some embodiments the spray gun 112 sprays the coating in the form of a fine mist (e.g., an atomized spray). The nozzle has a spray pattern that defines, for example, the shape of the spray pattern, the spray angle(s), and the type of spray that is generated. In some embodiments the valve 194 is part of the spray gun 112.

The container transporter 164 receives containers C from the container supply 186, where the containers C are at least temporarily stored. The container transporter 164 can include a variety of devices operable to move the containers through the spray machine 160, such as conveyors, chutes, and the like.

The transport controller is in data communication with the spray system controller 182, and controls the operation of the container transporter 164, including the drive motors such as the turret motor(s) 202 and spinner motor(s) 204.

The turret motor 202 is operatively coupled to the turret 170. When activated, the turret motor 202 causes the turret 170 to rotate to the next container holder 114 to be sprayed. When multiple spray guns are used, the turret motor 202 may rotate the turret 170 multiple container positions at once.

The spinner motor 204 is operatively coupled to the spinner 172. In some embodiments the spinner 172 defines a rear end of the container holder 114. When a container is loaded into the container holder 114, the spinner 172 fastens to a closed end of the container C, such as using magnets. When activated, the spinner motor 204 causes the spinner 172 to rotate, which in turn rotates the container C. The spray assembly 162 is synchronized with the turret motors and spinner motors by the spray system controller 182 to spray the coating onto the container at the appropriate time when the container is in the proper spray position and (if desired) is rotating at the proper speed.

After spraying, the turret motor 202 rotates the turret 170 to eject the coated container CC from the container holder 114, causing it to exit the spray machine 160.

In some embodiments the spray system controller 182 is the main controller of the spray machine 160, which operates to instruct and synchronize the various components of the spray machine 160. In this example, the spray system controller 182 is in data communication with the spray gun controller 196, which controls the spray assembly 162, and with the transport controller 200, which controls the container transporter.

In some embodiments the spray system controller 182 also includes a control interface 184, through which the spray machine 160 can interact with a human operator. The control interface 184 can include various input devices, and various output devices. The human operator can provide input through the control interface 184 to define setup parameters, operational configurations, and instructions to start or stop the spray machine 160. Similarly, the spray system controller 182 can provide status and operational reports and notifications to the human operator through the control interface 184.

In some embodiments any one or more of the spray system controller 182, spray gun controller 196, and transport controller 200 are a computing device, such as including a processing device and a memory device. An example of a memory device is a computer readable storage device. Additional examples of a computing device are illustrated and described in further detail herein with reference to FIG. 6.

Figure 5:
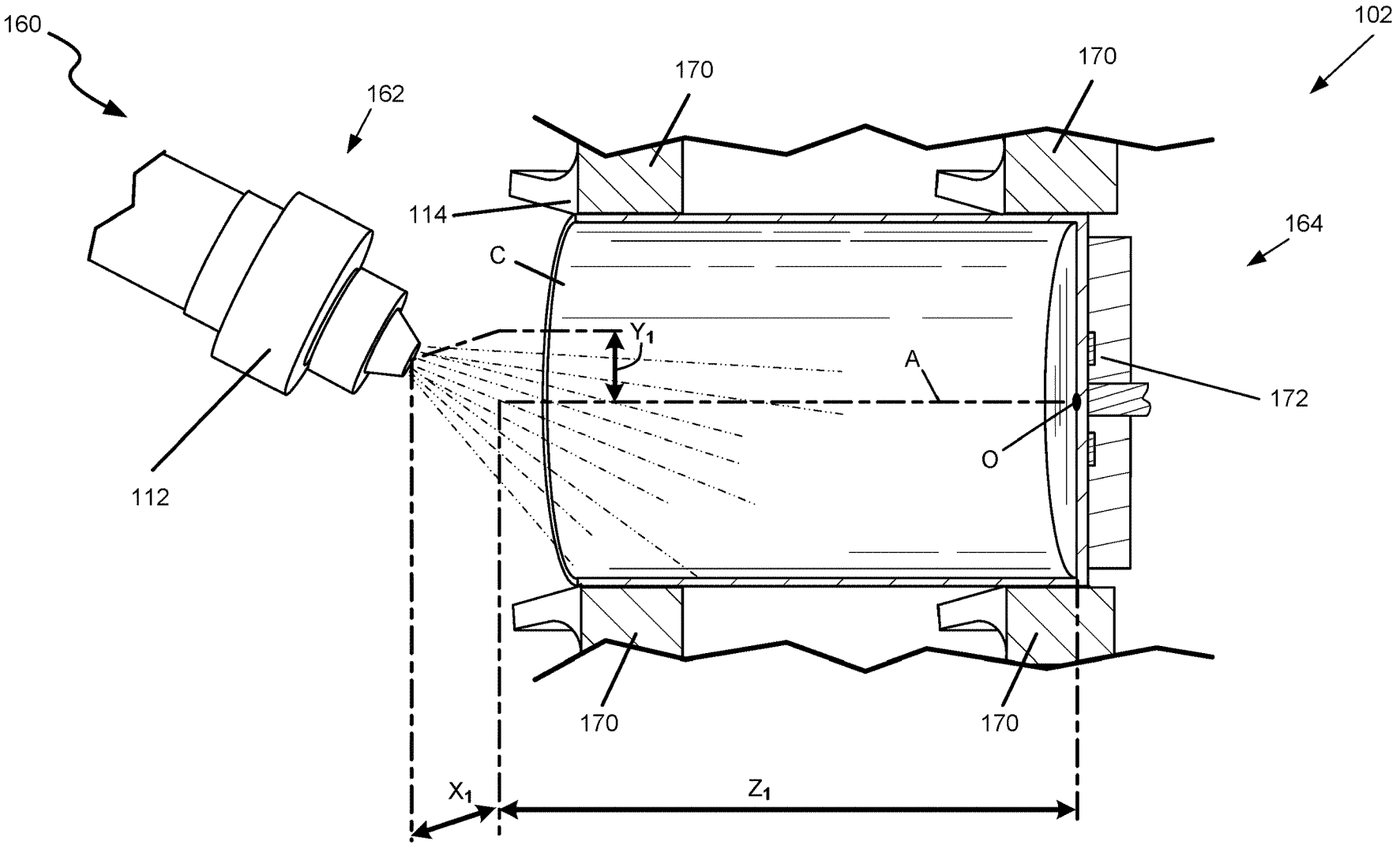
FIG. 5 is a schematic block diagram illustrating an example alignment of a spray gun with a container C and container holder of an example spray machine.
Figure 6:
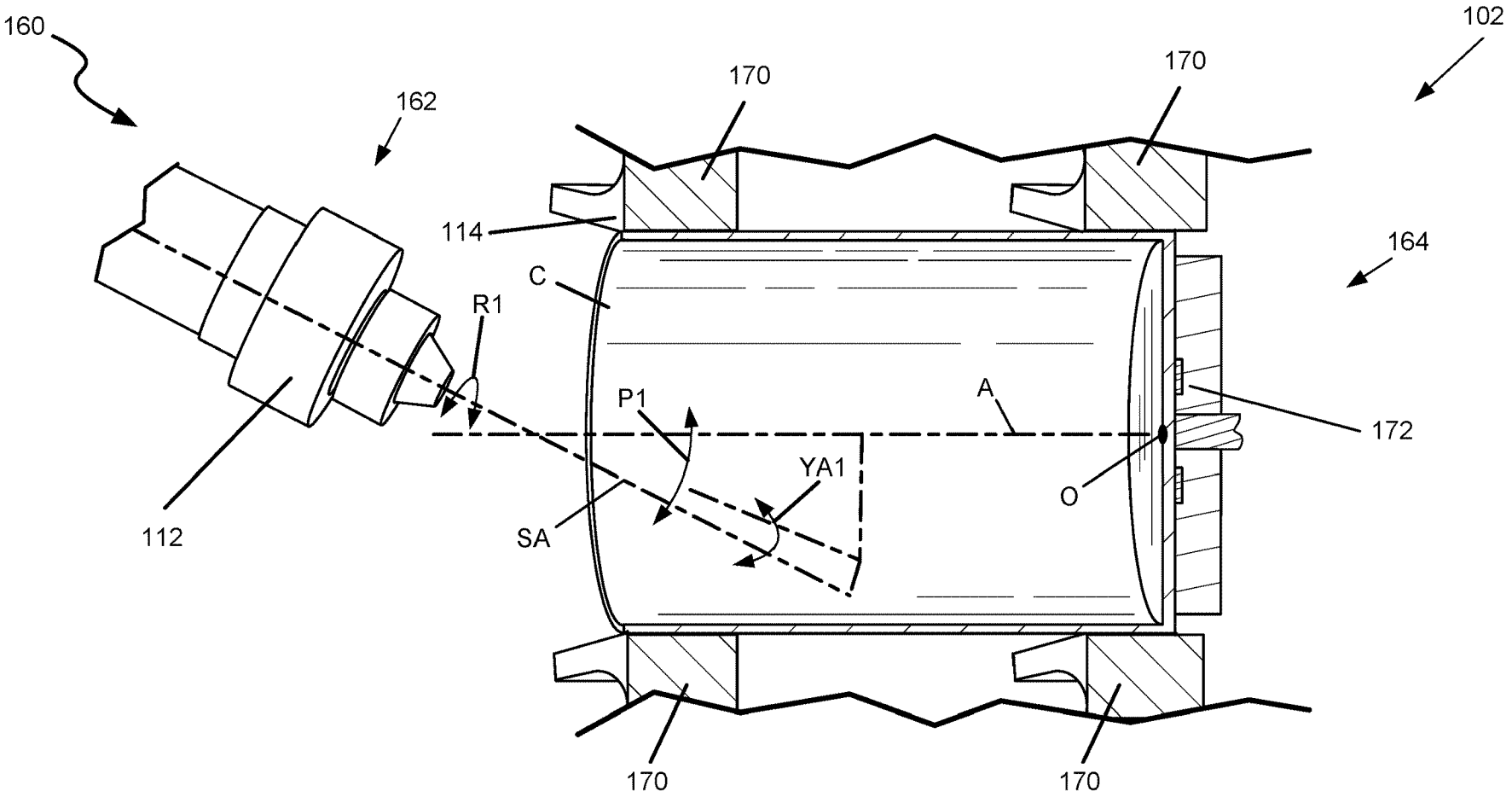
FIG. 6 is a schematic diagram illustrating the orientation of the spray gun.

FIGS. 5 and 6 are schematic block diagrams illustrating an example alignment of a spray gun 112 with a container C and container holder 114 of an example spray machine 160. FIG. 5 illustrates the position of the spray gun 112, and FIG. 6 illustrates the orientation of the spray gun 112. FIGS. 5 and 6 both show a partial cross-section of the container C and the container holder 114 of the spray machine 160 (and more specifically the lab spray machine 102, which is an example of the spray machine 160). FIGS. 5 and 6 also illustrate examples of the operations 142 and 144 of the method 140 of aligning a spray gun 112 of a container spray machine 160, shown in FIG. 2.

In this example, the spray machine 160 includes the spray assembly 162 and container transporter 164. The example spray assembly 162 includes a spray gun 112 mounted to an adjustable gun mount 166 (FIG. 3). The example container transporter 164 includes a turret 170 with a container holder 114.

As discussed with respect to FIG. 2, the operation 142 is performed to determine a proper alignment of a spray gun 112. The alignment of the spray gun 112 to the container holder 114 and container C is important in order for the spray gun 112 to apply the coating to the container C in such a way that the coating has the desired characteristics. It is also important to avoid waste that may result from overspraying.

In typical applications there is not one proper alignment for the spray gun. Instead, there are many variables that require changes to the alignment. Some of those variables include the configuration of the spray gun, the configuration of the nozzle, the coating composition, the container configuration (size, shape, and material), the intended use of the container (intended contents, and characteristics of same), the speed of rotation of the spinner 172, the environment (temperature, humidity, altitude, etc.), and many other possible variables.

In one example, a lab spray machine 102 is used to determine a proper alignment for the spray gun 112 using a particular set of these variables. For example, a particular type of container is selected to be coated with a particular coating using a particular spray gun with a particular spray nozzle under certain environmental conditions. Adjustments to the spray gun 112 alignment can then be made and tests can be run by spraying containers C with that particular set of variables. The coated containers can then be tested to determine whether the coating has certain characteristics, including whether it satisfies one or more predetermined criteria. Once the coating is determined to satisfy the predetermined criteria, the spray gun 112 can be determined to be in proper alignment for that particular set of variables.

Examples of predetermined criteria for the coating include: an amount of a surface that is coated, a thickness of the coating (including, e.g., an average overall coating thickness as well as coating thicknesses at different locations of the container such as, e.g., upper sidewall, lower sidewall, etc.), an amount of surface that is exposed, and an electrical resistance of the coating or electrical current passage level of the coating (e.g., to indicate whether the coating is free of pores or other unsuitable coating discontinuities). In some embodiments the surface is an interior surface.

Once the spray gun 112 is properly aligned, measurements can be taken to measure the alignment of the spray gun 112.

The measurements are taken with respect to one or more reference points. A variety of possible reference points can be used. In this example the alignment is defined with reference to a central axis A and an origin point O. The central axis A is a central axis of the container C, the container holder 114, and the axis of rotation of the spinner 172. The origin point O is a point along the central axis A on the surface of the spinner 172. But as noted, other reference points can be used in other embodiments.

One or more measurement tools are used to measure the alignment of the spray gun 112. Examples of measurement tools include rulers, calipers, laser measurement tools, protractors, scanners, and the like.

In some embodiments the alignment of the spray gun 112 includes both a position and an orientation of the spray gun 112. An example position of spray gun 112 is illustrated in FIG. 5. The position is the location of a point of the spray gun 112 relative to the reference point. In this example, the location of the point of the spray gun 112 is measured in three-dimensions, including X, Y, Z coordinates where the reference point is the origin point O. The dimension X represents the horizontal offset in a side-to-side (left/right) direction. X1 is a distance of the horizontal/side-to-side offset from the central axis A. The dimension Y represents the vertical offset in an up/down direction. Y1 is a distance of the vertical/up/down offset from the central axis A. The dimension Z represents the horizontal offset in the forward/backward direction. Z1 is a distance of the horizontal/forward/backward position away from the origin point O along the central axis A.

FIG. 6 illustrates an example of the orientation of the spray gun 112. The orientation is the direction that the spray gun is pointing with respect to the reference. The direction of the spray gun 112 is along the spray axis SA. In this example, the orientation of the spray gun 112 is measured by three angles P1, YA1, R1 with respect to the central axis A. The angle P1 is the pitch of the spray gun 112, and is an up/down angle of the spray axis SA with respect to the central axis A. The angle YA1 is the yaw of the spray axis SA, and is the horizontal side-to-side angle of the spray gun with respect to the central axis A. The angle R1 is the roll of the spray gun 112, and is an angle of rotation of the spray gun about the spray axis SA.

Each of the position and orientation can be measured using measurement tools. The measurements are then provided to the spray gun alignment jig generator 106 as shown in FIG. 1, and as further described herein with reference to FIGS. 7-10.

Figure 7:
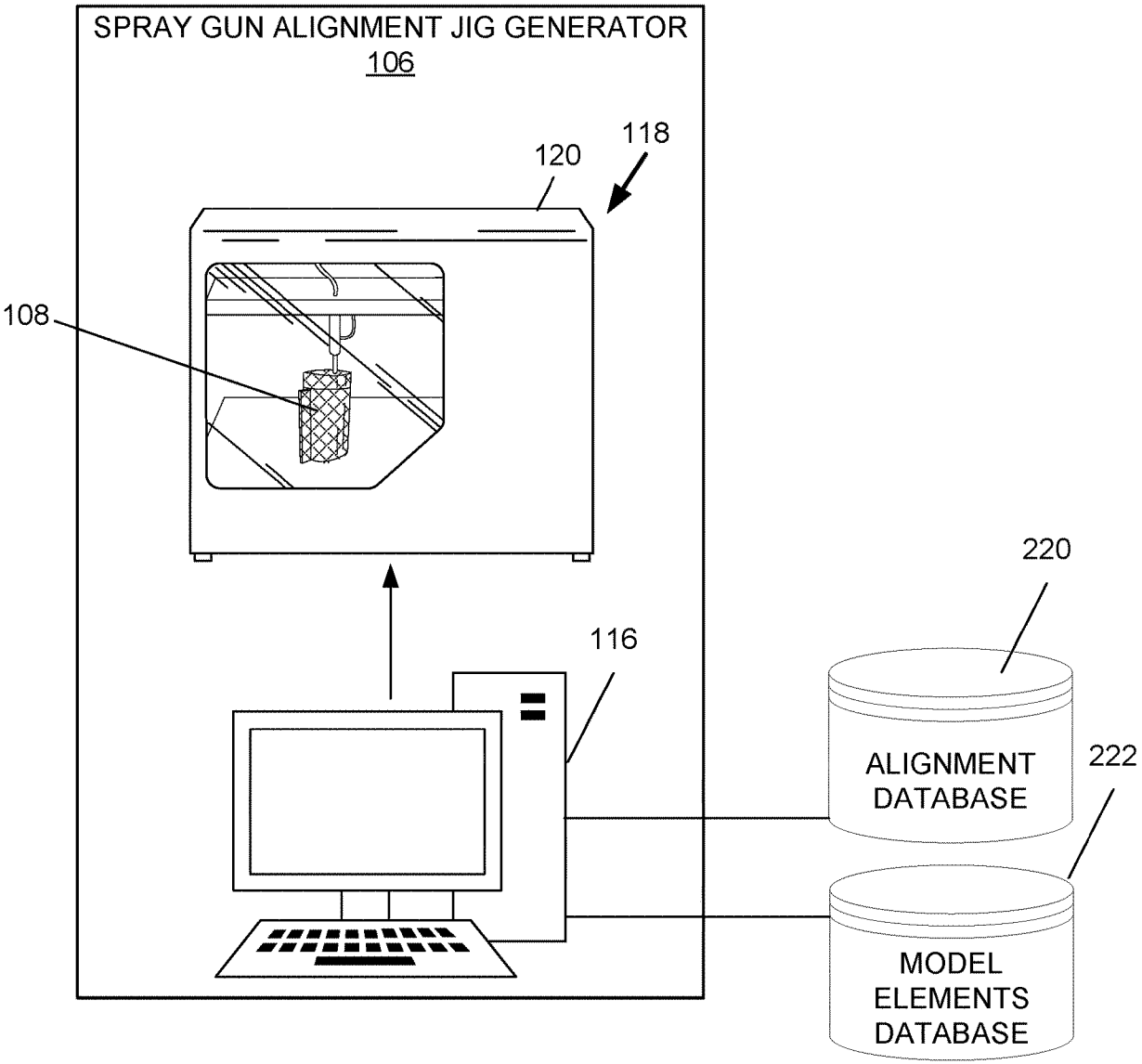
FIG. 7 is a schematic block diagram illustrating an example of the spray gun alignment jig generator for generating a spray gun alignment jig.

FIG. 7 is a schematic block diagram illustrating an example of the spray gun alignment jig generator 106 for generating a spray gun alignment jig 108. In this example, the spray gun alignment jig generator 106 includes the computing device 116 and the jig fabrication machine 118, such as a 3D printer 120. Some embodiments further include an alignment database 220 and a model elements database 222.

Figure 8:
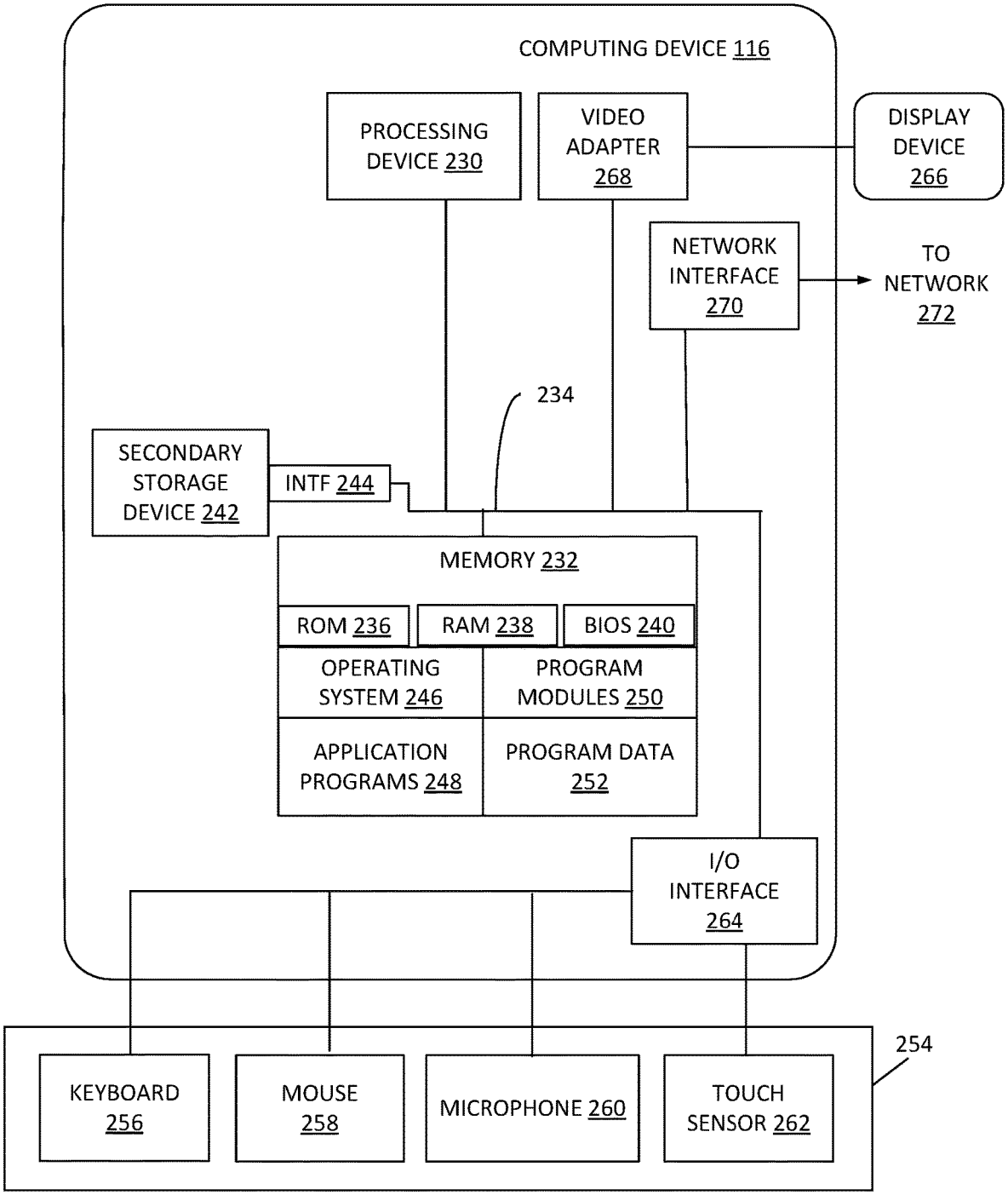
FIG. 8 illustrates an exemplary architecture of a computing device that can be used to implement aspects of the present disclosure.
Figure 9:
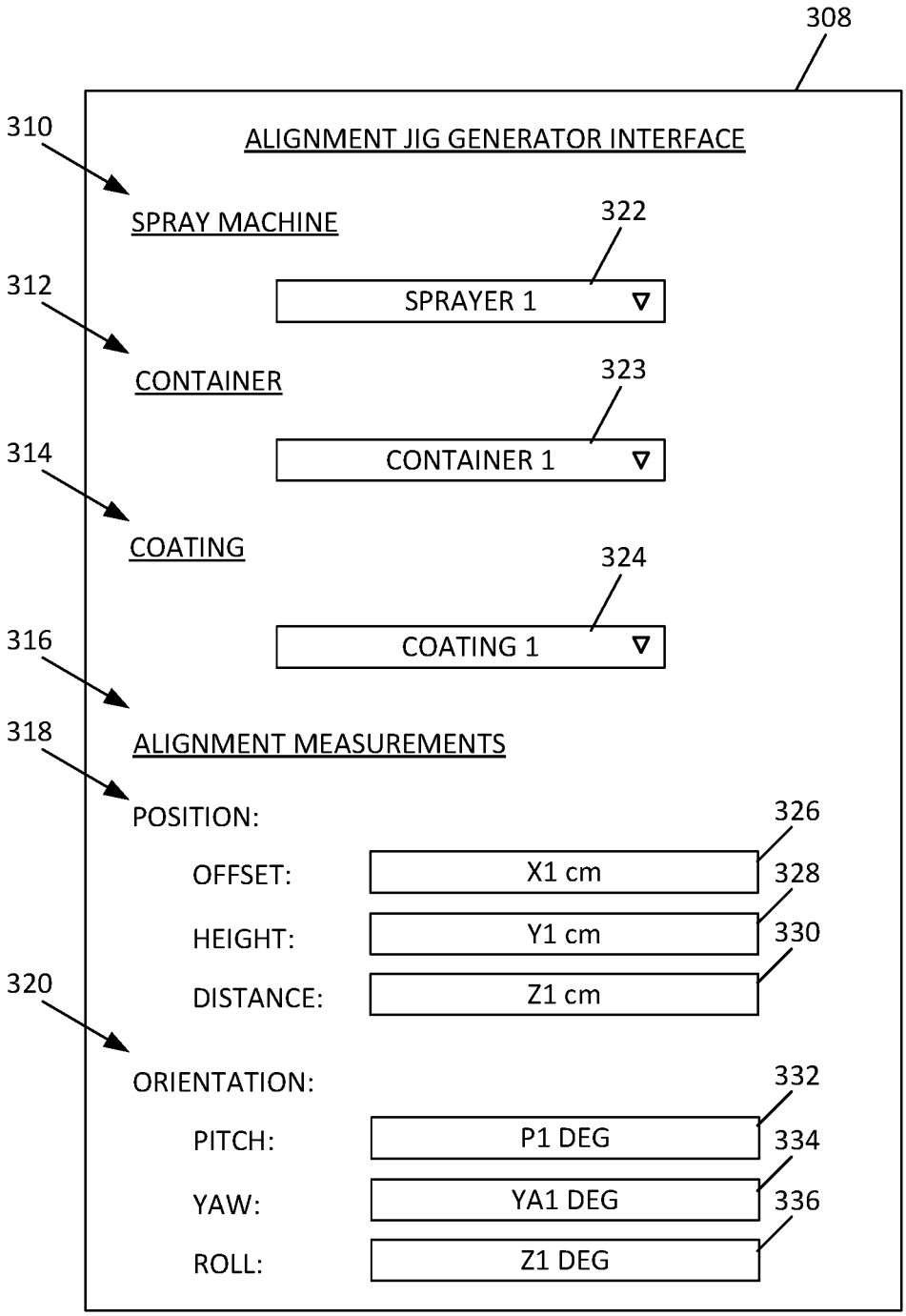
FIG. 9 is a schematic block diagram illustrating an example alignment jig generator interface, which can be used to collect alignment measurements from an operator.

Once a proper alignment of the spray gun 112 has been determined for a particular coating and spray machine 160, the alignment measurements are supplied to the computing device 116. The computing device 116 uses the measurements to generate a digital model of an alignment jig 108 that is sized and configured for positioning the spray gun 112 into the proper alignment. An example of the computing device 116 is illustrated in FIG. 8. An example alignment jig generator interface 308 is illustrated in FIG. 9. And, an example of the generation of the digital model of the alignment jig 108 is illustrated and described in further detail herein with reference to FIGS. 11-19.

Once the digital model of the alignment jig has been generated, it can be sent to the jig fabrication machine 118 to be fabricated. The jig fabrication machine 118 generates the physical alignment jig 108 from the digital model.

Figure 10:
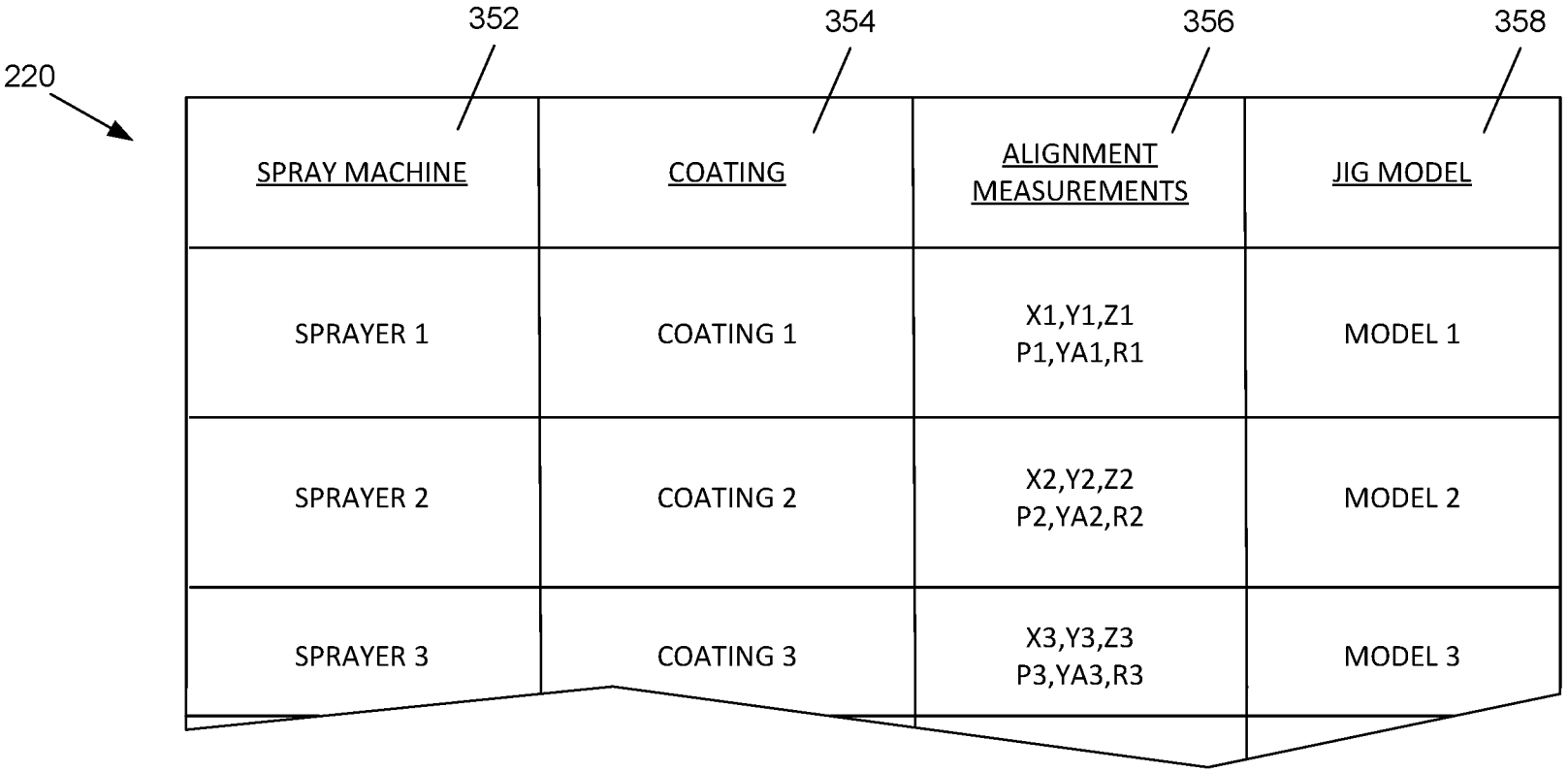
FIG. 10 is a schematic block diagram illustrating an example of the alignment database.

Some embodiments include an alignment database 220, which can be part of the spray gun alignment jig generator 106 (e.g., stored in computing device 116) or separate from it but accessible to the computing device 116 across a data communication network. The alignment database 220 stores alignment measurements and other data. Accordingly, in some embodiments the computing device 116 can receive the alignment measurements by retrieving the measurements from the alignment database 220. An example of the alignment database 220 is illustrated in FIG. 10.

Figure 13:
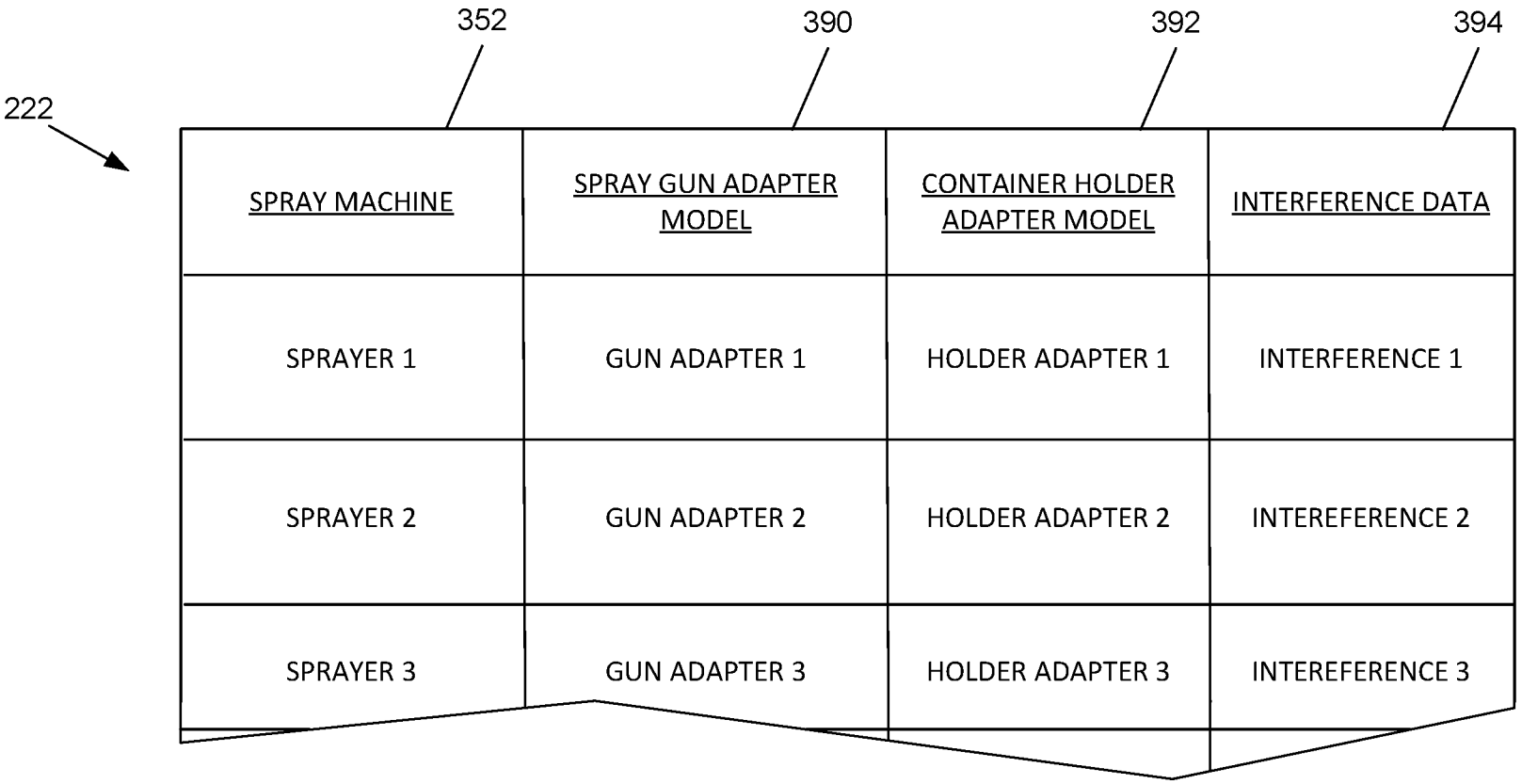
FIG. 13 is a schematic block diagram illustrating an example of the model elements database.

Some embodiments include a model elements database 222, which can similarly be part of the spray gun alignment jig generator 106 or separate from it but accessible to the computing device 116 across a data communication network. The model elements database 222 stores digital models of model elements associated with particular spray machines 160, which can be utilized by the computing device 116 in generating a digital model of an alignment jig 108. An example of the model elements database 222 is illustrated in FIG. 13.

FIG. 8 illustrates an exemplary architecture of a computing device that can be used to implement aspects of the present disclosure, including any of the computing device 116 (FIGS. 1 and 7), the spray system controller 182 (FIG. 4), the spray gun controller 196 (FIG. 4), and the transport controller 200 (FIG. 4). The computing device illustrated in FIG. 8 can be used to execute the operating system, application programs, and software modules (including the software engines) described herein. By way of example, the computing device will be described below as the computing device 116. To avoid undue repetition, this description of the computing device will not be separately repeated herein for each of the other computing devices, but such devices can also be configured as illustrated and described with reference to FIG. 8.

The computing device 116 includes, in some embodiments, at least one processing device 230, such as a central processing unit (CPU). A variety of processing devices are available from a variety of manufacturers, for example, Intel or Advanced Micro Devices ("AMD"). In this example, the computing device 116 also includes a system memory 232, and a system bus 234 that couples various system components including the system memory 232 to the processing device 230. The system bus 234 is one of any number of types of bus structures including a memory bus, or memory controller; a peripheral bus; and a local bus using any of a variety of bus architectures.

Examples of computing devices suitable for the computing device 116 include a server computer, a desktop computer, a laptop computer, a tablet computer, a mobile computing device (such as a smart phone, an iPod® or iPad® mobile digital device, or other mobile devices), or other devices configured to process digital instructions.

The system memory 232 includes read only memory 236 and random access memory 238. A basic input/output system 240 containing the basic routines that act to transfer information within computing device 116, such as during start up, is typically stored in the read only memory 236.

The computing device 116 also includes a secondary storage device 242 in some embodiments, such as a hard disk drive, for storing digital data. The secondary storage device 242 is connected to the system bus 234 by a secondary storage interface 244. The secondary storage devices 242 and their associated computer readable media provide non-volatile storage of computer readable instructions (including application programs and program modules), data structures, and other data for the computing device 116.

Although the exemplary environment described herein employs a hard disk drive as a secondary storage device, other types of computer readable storage media are used in other embodiments. Examples of these other types of computer readable storage media include solid state memory, magnetic cassettes, flash memory cards, digital video disks, compact disc read only memories, digital versatile disk read only memories, random access memories, or read only memories. Some embodiments include non-transitory media. Additionally, such computer readable storage media can include local storage or cloud-based storage.

A number of program modules can be stored in secondary storage device 242 or memory 232, including an operating system 246, one or more application programs 248, other program modules 250 (such as the software engines described herein), and program data 252. The computing device 116 can utilize any suitable operating system, such as Microsoft Windows™, Google Chrome™, Apple OS, and any other operating system suitable for a computing device.

In some embodiments, a user provides inputs to the computing device 116 through one or more input devices 254. Examples of input devices 254 include a keyboard 256, mouse 258, microphone 260, and touch sensor 262 (such as a touchpad or touch sensitive display). Other embodiments include other input devices 254. The input devices are often connected to the processing device 230 through an input/output interface 264 that is coupled to the system bus 234. These input devices 254 can be connected by any number of input/output interfaces, such as a parallel port, serial port, game port, or a universal serial bus. Wireless communication between input devices and the interface 264 is possible as well, and includes infrared, BLUETOOTH® wireless technology, IEEE 802.11, cellular, or other radio frequency communication systems in some possible embodiments.

In this example embodiment, a display device 266, such as a monitor, liquid crystal display device, projector, or touch sensitive display device, is also connected to the system bus 234 via an interface, such as a video adapter 268. In addition to the display device 266, the computing device 116 can include various other peripheral devices (not shown), such as speakers or a printer.

When used in a local area networking environment or a wide area networking environment (such as the Internet), the computing device 116 is typically connected to the network 272 through a network interface 270, such as an Ethernet interface. Other possible embodiments use other communication devices. For example, some embodiments of the computing device 116 include a modem for communicating across the network.

The computing device 116 typically includes at least some form of computer readable media. Computer readable media includes any available media that can be accessed by the computing device 116. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the computing device 116. Computer readable storage media does not include computer readable communication media.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The computing device illustrated in FIG. 8 is also an example of programmable electronics, which may include one or more such computing devices, and when multiple computing devices are included, such computing devices can be coupled together with a suitable data communication network so as to collectively perform the various functions, methods, or operations disclosed herein.

FIG. 9 is a schematic block diagram illustrating an example alignment jig generator interface 308, which can be used to collect alignment measurements from an operator. In this example, the alignment jig generator interface 308 includes a spray machine input region 310, a container input region 312, a coating input region 314, and an alignment measurements input region 316. The example alignment measurements input region 316 includes a position section 318 and an orientation section 320. Inputs fields 322, 323, 324, 326, 328, 330, 332, 334, and 336 are also shown.

After measurements have been taken, in some embodiments the measurements are provided to the computing device 116 by the operator inputting the measurements. As one example, the measurements can be provided through an alignment jig generator interface 308 that is presented to the operator on the computing device 116 display device 266. Alternatively, the operator may access the interface 308 through another computing device, and the data is transmitted to the computing device 116, such as through a network 272 (shown in FIG. 8). The data may be stored in the alignment database 220 shown in FIG. 7.

In this example, the interface 308 includes a spray machine input region 310, where the computing device 116 prompts the user to identify in the input field 322 the spray machine for which measurements have been taken. In some embodiments the computing device 116 retrieves from the alignment database a list of the spray machines which are in the database, and the user can select the spray machine from the list, or a new spray machine can be added. The input is provided into field 322. As discussed in further detail below, each spray machine can be associated with a set of data about the spray machine, and can also be associated with pre-configured model elements.

The container input region 312 is similarly presented to the operator to prompt the operator to identify the container that was sprayed by the spray machine. In some embodiments the computing device 116 retrieves from the alignment database a list of the containers that are in the database, and the user can select the container from the list, or a new container can be added. The input is provided into field 323.

The coating input region 314 is similarly presented to the operator to prompt the operator to identify the coating that was sprayed by the spray machine. In some embodiments the computing device 116 retrieves from the alignment database a list of the coatings that are in the database, and the user can select the coating from the list, or a new coating can be added. The input is provided into field 324.

The alignment measurements input region 316 is also presented to the operator to prompt the operator to enter the measurements that were taken. In this example, the interface prompts the user to enter position measurements into the position section 318 and orientation measurements into the orientation section 320. The position measurements for the spray gun 112 are entered into the position section 318, and more specifically the offset, height, and distance measurements are entered into the respective fields 326, 328, and 330. The orientation measurements are entered into the orientation section 320, and more specifically the pitch, yaw, and roll measurements are entered into the respective fields 332, 334, and 336.

FIG. 10 is a schematic block diagram illustrating an example of the alignment database 220. The alignment database 220 includes one or more data structures that store data including, for example, spray machine identifiers 352, coating identifiers 354, alignment measurements 356, and jig models 358.

After the measurements of the proper alignment of a spray gun 112 have been taken, and data entered such as through the alignment jig generator interface 308, shown in FIG. 9, the data can be stored in data structures in the alignment database 220.

This example shows the data collected from the operator, as discussed herein with reference to FIG. 9, being stored in a first row of the alignment database 220. More specifically, the data includes a spray machine identifier 352 that identifies sprayer 1, a coating identifier 354 that identifies coating 1, and the alignment measurements 356 that identify both the position and the orientation of the alignment of the spray gun.

Additionally, after a digital model of the alignment jig 108 has been generated, the digital model can also be stored in the alignment database 220. In this example the alignment database 220 includes a digital model of the alignment jig 108 as model 1.

Additional measurement data can also be stored in the alignment database 220, as represented by the additional rows of data shown in FIG. 10

Figure 11:
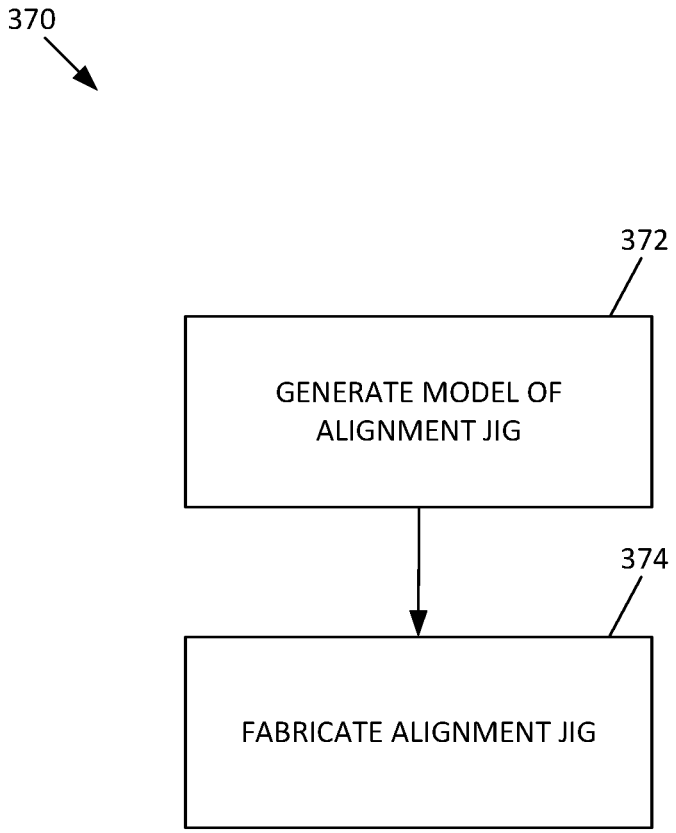
FIG. 11 is a flow chart illustrating an example method of generating a spray gun alignment jig.

FIG. 11 is a flow chart illustrating an example method 370 of generating a spray gun alignment jig 108 (shown in FIG. 7). The method 370 is an example of the operation 146, shown in FIG. 2. In this example the method 370 includes an operation 372 and an operation 374.

The operation 372 is performed to generate a digital model of the alignment jig 108. In some embodiments, the operation 372 is performed by the computing device 116, shown in FIGS. 7-8. An example of the operation 372 is illustrated and described in more detail with reference to FIGS. 12-19.

The operation 374 is performed to fabricate the alignment jig 108. The operation 374 utilizes the digital model of the alignment jig 108 generated in operation 372, and fabricates the physical alignment jig 108 that can subsequently be used for aligning the spray gun 112 with the container holder 114 and container C, as previously discussed. An example of the operation 374 is illustrated and described in more detail with reference to FIGS. 20-21.

Figure 12:
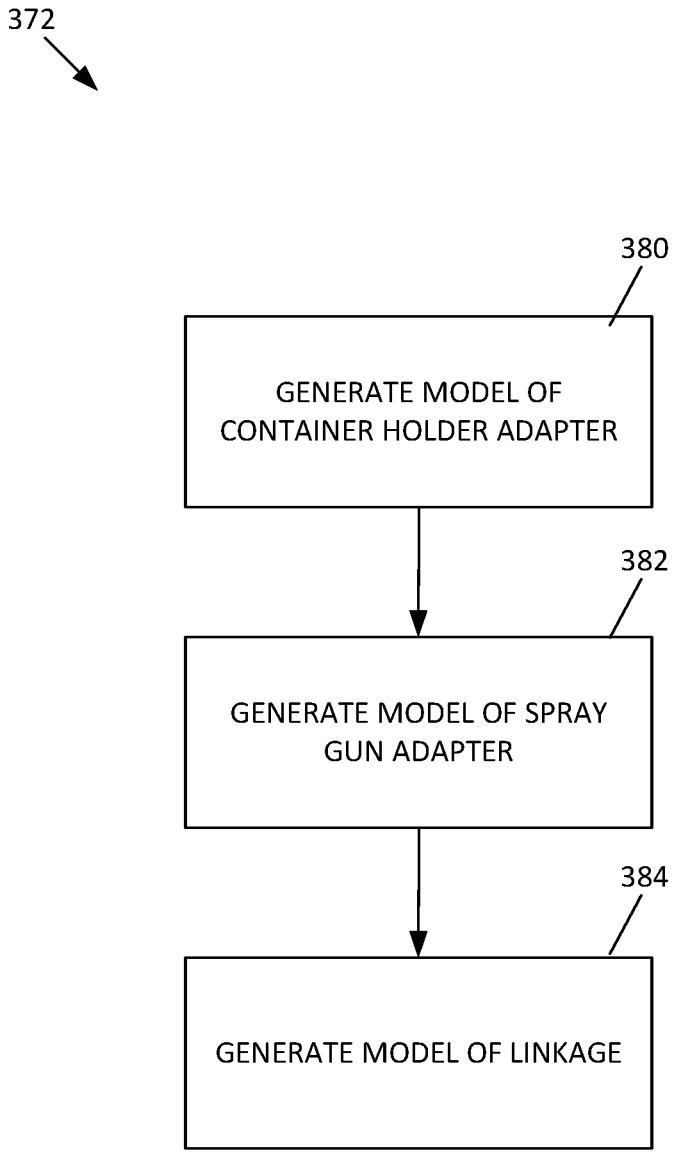
FIG. 12 is a flow chart illustrating an example method of generating a digital model of the alignment jig 108.

FIG. 12 is a flow chart illustrating an example method 372 of generating a digital model of the alignment jig 108. In this example the method 372 includes operations 380, 382, and 384.

The operation 380 is performed to generate a digital model of a container holder adapter. The container holder adapter is a portion of the alignment jig 108 that is configured to engage with a container holder 114 of the spray machine 160. An example of the operation 380 is illustrated and described in more detail herein with reference to FIG. 14.

The operation 382 is performed to generate a digital model of a spray gun adapter. The spray gun adapter is a portion of the alignment jig 108 that is configured to engage with the spray gun 112 of the spray machine 160. An example of the operation 382 is illustrated and described in more detail herein with reference to FIGS. 15-16.

The operation 384 is performed to generate a digital model of a linkage. The linkage is a portion of the alignment jig 108 that is configured to connect the spray gun adapter and the container holder adapter in a predetermined alignment. An example of the operation 384 is illustrated and described in more detail herein with reference to FIGS. 17-19.

The operations of method 372 can be performed in any order. For example, the operation 382 that generates the digital model of the spray gun adapter can be performed before the operation 380 that generates the digital model of the container holder adapter.

FIG. 13 is a schematic block diagram illustrating an example of the model elements database 222. The model elements database 222 includes one or more data structures that store data including, for example, spray machine identifiers 352, spray gun adapter models 390, container holder adapter models 392, and interference data 394.

In some embodiments, certain component parts of the alignment jig 108 can be predefined for each spray machine. For example, if sprayer 1 (shown in the spray machine identifier 352) is known to have a particular spray gun 112, a spray gun adapter model 390 can be generated that has a particular configuration designed to interface with that spray gun. The spray gun adapter model 390 can then be stored in the database as represented by gun adapter 1, shown in FIG. 13. Similarly, other spray gun adapter models 390 can be generated for spray guns of other spray machines, and stored in the database 222.

The spray machine may also have a particular known configuration of its container holder adapter, and a container holder adapter model 392 can be generated that has a particular configuration designed to interface with that container holder. The container holder adapter model 392 can then be stored in a database 222 as represented by holder adapter 1, shown in FIG. 13. Similarly, other container holder adapter models 392 can be generated for container holders of other spray machines, and stored in the database 222.

In some embodiments, model elements database 222 also includes interference data 394. The interference data 394 is associated with a particular spray machine 160 by the spray machine identifier 352, such as sprayer 1, and identifies the location of any portion of the spray machine within the vicinity of the spray gun 112 and container holder 114 that may interfere with the alignment jig 108. One example of the interference data 394 is a three-dimensional model of at least a portion of the spray machine. In this way, the computing device 116 can use the interference data 394 to design the alignment jig 108 so that it does not interfere with any portion of the spray machine. An example process that utilizes the interference data 394 to design the alignment jig 108 is described in further detail with reference to FIG. 19.

FIGS. 14-19 illustrate examples of the method 372 of generating a digital model of the alignment jig 108, and its operations 380, 382, and 384 of FIG. 12, which may be performed by the computing device 116 of the spray gun alignment jig generator 106. In some embodiments, the computing device 116 provides a model space 400 in which the digital model of the alignment jig 108 is designed. The model space 400 is a working environment of a computer program, such as a computer aided design (CAD) software application (which includes various available 3D modelling software applications). A wide variety of CAD software applications are available and can be utilized. Several examples include Autodesk® AutoCAD®, Dassault Systemes® Solidworks®, and Autodesk® Fusion 360° ™. The model space 400 can be displayed on a display device 266 of the computing device 116, or can be executed within the computing device 116 without being displayed.

The operations of method 372 can be fully automated by the computing device 116, or can be performed in cooperation with a human operator (i.e., partially automated and partially manual). The computer aided design software application includes software engines and algorithms implemented as tools, functions, or macros, for example, to perform the operations described herein.

It should be appreciated that the configuration of the digital model of the various components described herein is the same or very similar to the configuration of the actual physical components fabricated from the digital model. Accordingly, the same names and reference numbers will be used for like components regardless of whether such components are in the digital model or the physical component fabricated from the digital model.

Figure 14:
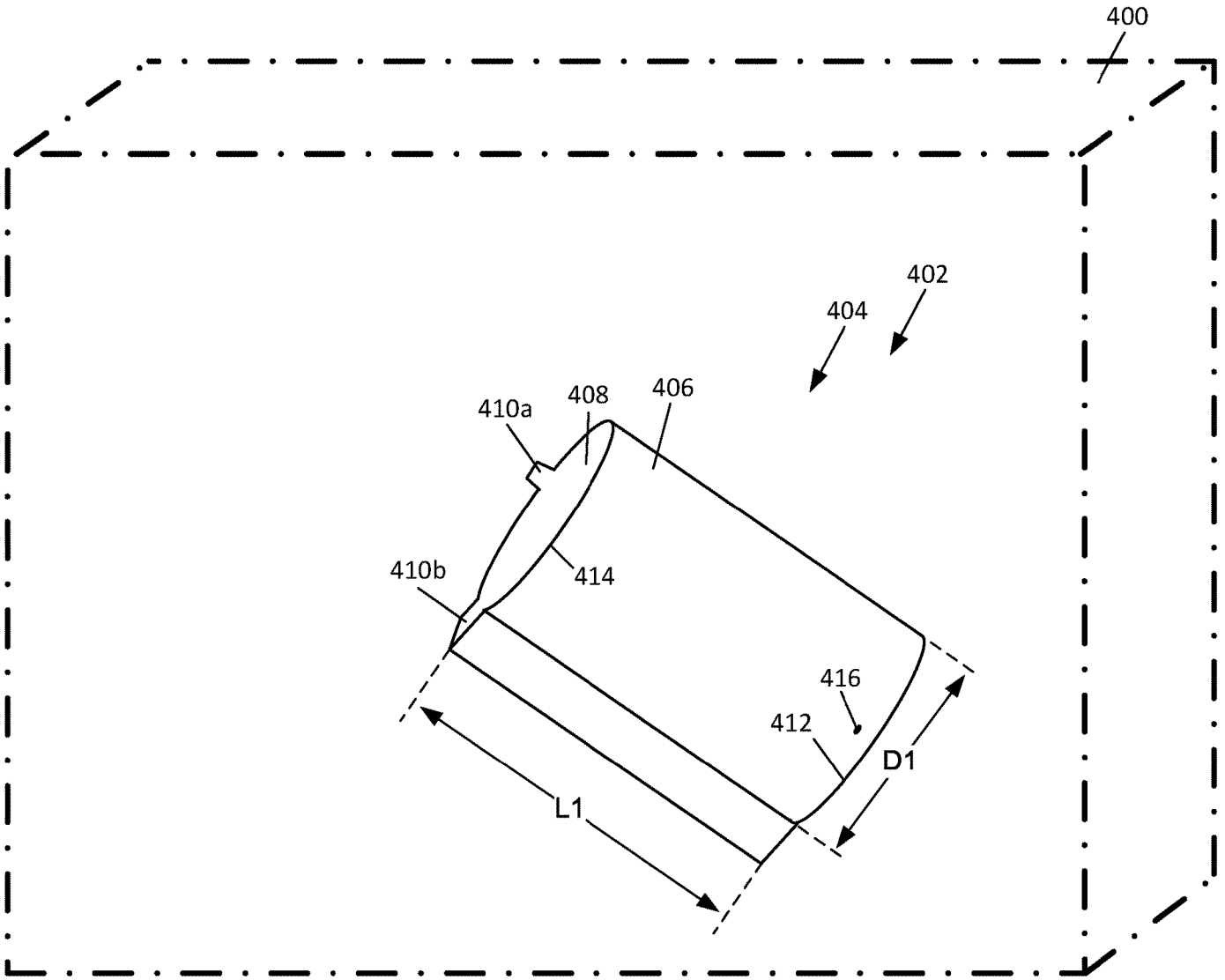
FIG. 14 is a schematic diagram illustrating an example digital model of a container holder adapter.

FIG. 14 is a schematic diagram illustrating an example digital model 402 of a container holder adapter 404. The digital model 402 is shown in the model space 400 of the computing device 116 shown in FIG. 7. In this example, the container holder adapter 404 includes a body 406 including a container portion 408 and an orientation guide 410 (such as including 410*a* and 410*b*). Also shown are a first end 412, a second and 414, and a container reference point 416. FIG. 14 also illustrates an example of the operation 380 shown in FIG. 12.

The container holder adapter 404 is a portion of the alignment jig 108 that is configured to engage with the container holder 114 of the spray machine 160 (FIG. 3). As such, the container holder adapter 404 is designed so that it will fit in a container holder 114 of the spray machine 160.

In some embodiments, an operator is prompted to select from a user interface an identification of the spray machine for which the alignment jig 108 is to be designed. The operator selects the spray machine, such as sprayer 1, as shown in FIG. 13. The computing device 116 then retrieves the digital model 402 of the container holder adapter 404 from the model elements database 222, based on the identification of the spray machine selected by the operator. If a digital model 402 of the container holder adapter 404 does not exist for the selected spray machine, a new model can be generated based on the configuration of the container holder 114, such as using the interference data 394 (FIG. 13).

The body 406 includes a container portion 408 that has a size and shape that mimics the container C, so that it can be inserted within and held by the container holder 114 in the same way that the container holder 114 holds a container while it is being sprayed. If the spray machine 160 is configured to spray a cylindrical food can, for example, the container portion 408 is sized and shaped to mimic the cylindrical size and shape of the food can. In this example, the container portion 408 has a length L1 and a diameter D1. The length L1 (from a first end 412 to a second end 414) is selected to be the same or similar length as the container C, and the diameter D1 is selected to be the same or similar diameter as the container C. The size and shape of the container can be determined by the computing device 116 by retrieving the information from the alignment database 220 for the container identified in field 323 (FIG. 9). The container portion 408 can have other shapes and sizes in other embodiments.

The container portion 408 is designed with reference to a particular container reference point 416. In this example, the container reference point 416 represents the same reference point O from which the spray gun alignment measurements were taken, as discussed herein with reference to FIGS. 5 and 6. Accordingly, the shape of the container portion 408 is designed so that a central axis is aligned with the container reference point 416 and the length L1 is measured as a distance from the container reference point 416.

The container portion 408 has a size that is the same or similar to that of the container C that is to be sprayed. Examples of containers C can include both food and beverage cans, as well as other cans such as metered dose inhaler cans (e.g., for dispensing of pharmaceutical products such as asthma inhalants), aluminum monobloc cans (e.g., for pressurized hair-dyes, cleaning products, air freshener, and the like), etc.

Some standard can sizes, which are examples of suitable containers C, are shown in Table 1.

TABLE 1

| Can Type | Dimensions (diameter D1 × height L1 | Capacity (U.S. fluid ounces) |
|---|---|---|
| 6Z | 2 2/16 × 3 1/2 inches (5.4 cm × 8.89 cm) | 6.08 (179.81 ml) |
| 8Z Short | 2 11/16 × 3 inches (6.83 cm × 7.62 cm) | 7.93 (234.52 ml) |
| 8Z Tall | 2 11/16 × 3 2/8 inches (6.83 cm × 8.26 cm) | 8.68 (256.70 ml) |
| No. I (Picnic) | 2 11/16 × 4 inches (6.83 cm × 10.16 cm) | 10.94 (323.53 ml) |
| No. 211 Cylinder | 2 11/16 × 4 14/16 inches (6.83 cm × 12.38 cm) | 13.56 (401.02 ml) |
| No. 300 | 3 × 4 7/16 inches 7.62 cm × 11.27 cm) | 15.22 (450.11 ml) |
| No. 300 Cylinder | 3 × 5 9/16 inches (7.62 cm × 14.13 cm) | 19.40 (573.73 ml) |
| No. I Tall | 3 1/16 × 4 11/16 inches (7.78 cm × 11.91 cm) | 16.70 (493.88 ml) |
| No. 303 | 3 3/16 × 4 3/8 inches (8.1 cm × 11.11 cm) | 16.88 (499.20 ml) |
| No. 303 Cylinder | 3 3/16 × 5 9/16 inches (8.1 cm × 14.13 cm) | 21.86 (646.47 ml) |
| No. 2 Vacuum | 3 7/16 × 3 3/8 inches (8.73 cm × 8.57 cm) | 14.71 (435.03 ml) |
| No. 2 | 3 7/16 × 4 9/16 inches (8.73 cm × 11.59 cm) | 20.55 (607.74 ml) |
| Jumbo | 3 7/16 × 5 5/8 inches (8.73 cm × 14.29 cm) | 25.80 (763.00 ml) |
| No. 2 Cylinder | 3 7/16 × 5 6/8 inches (8.73 cm × 14.61 cm) | 26.40 (780.71 ml) |
| No. 1.25 | 4 1/16 × 2 3/8 inches (10.32 cm × 6.03 cm) | 13.81 (408.11 ml) |
| No. 2.5 | 4 1/16 × 4 11/16 inches (10.32 cm × 11.91 cm) | 29.79 (881.00 ml) |
| No. 3 Vacuum | 4 1/4 × 3 7/16 inches (10.8 cm × 8.73 cm) | 23.90 (706.81 ml) |
| No. 3 Cylinder | 4 1/4 × 7 inches (10.8 cm × 17.78 cm) | 51.70 (1528.95 ml) |
| No. 5 | 5 1/8 × 5 5/8 inches (13.02 cm × 14.29 cm) | 59.10 (1747.80 ml) |
| No. 10 | 6 3/16 × 7 inches (15.72 cm × 17.78 cm) | 109.43 (3236.23 ml) |
| 211 × 300 | 2 11/16 × 3 inches (6.83 cm × 7.62 cm) | 7.90 (233.63 ml) |
| 307 × 512 | 3 7/16 × 5 12/16 inches (8.73 cm × 14.61 cm) | 25.8 (763.00 ml) |

In one example, the length L1 is in a range from 1 to 24 inches (2.54 cm to 60.96 centimeters). In another example, the length L1 is in a range from 1 to 12 inches (2.54 to 30.48 centimeters). In yet another example, the length L1 is in a range from 3 to 7 inches (7.62 to 17.78 cm). The length L1 can also be referred to as a height L1.

In one example, the diameter D1 is in a range from 1 to 18 inches (2.54 to 45.72 centimeters). In another example, the diameter D1 is in a range from 2 to 12 inches (5.08 to 30.48 centimeters). In yet another example, the diameter D1 is in a range from 2.5 to 7 inches (6.35 to 17.78 centimeters).

In some embodiments the container C is a D&I (drawn and ironed) food can. In one example, the diameter D1 of the D&I can is in a range from 2 inches (50.8 mm) to 6 inches (152.4 mm). In another example, the diameter D1 of the D&I can is in a range from 2 and 11/16 inches (68.26 mm) to 3 and 7/16 inches (87.31 mm).

In one example, the length (height) L1 of the D&I can is in a range from 1 inch (25.4 mm) to 8 inches (203.2 mm). In another example, the length (height) L1 of the D&I can is in a range from 3 inches (76.2 mm) to 5 and 12/16 inches (146.05 mm).

In some embodiments the dimensions described herein are maximum dimensions. For example, some containers C have various dimensions due to the presence of features such as a neck or ribs, which can cause some portions of the container C to have a narrower diameter than others portions.

In some embodiments, the body 406 also includes an orientation guide 410. The orientation guide 410 provides one or more additional features to the body 406 to ensure that the container holder adapter 404 is inserted into the container holder 114 in the proper orientation. For example, when the container portion 408 has a cylindrical shape it could be rotated and inserted into the container holder 114 in a variety of different positions. Therefore, the orientation guide 410 is provided so that the body 406 can only be inserted one way into the container holder 114.

The particular configuration of the orientation guide 410 is selected based on the configuration of the spray machine 160. For an example spray machine 160 shown in FIG. 3, the container holder 114 is at least partially defined by a turret 170. The turret 170 has edge features adjacent to the container holder 114. In this example, the orientation guide 410 includes orientation fins 410*a* and 410*b* that extend outward from the container portion 408 and the adjacent to the edge features of the turret 170 when the container holder adapter 404 is inserted into the container holder 114. Other orientation guide 410 features can be used in other embodiments depending on the particular configuration of the spray machine 160.

Figure 15:
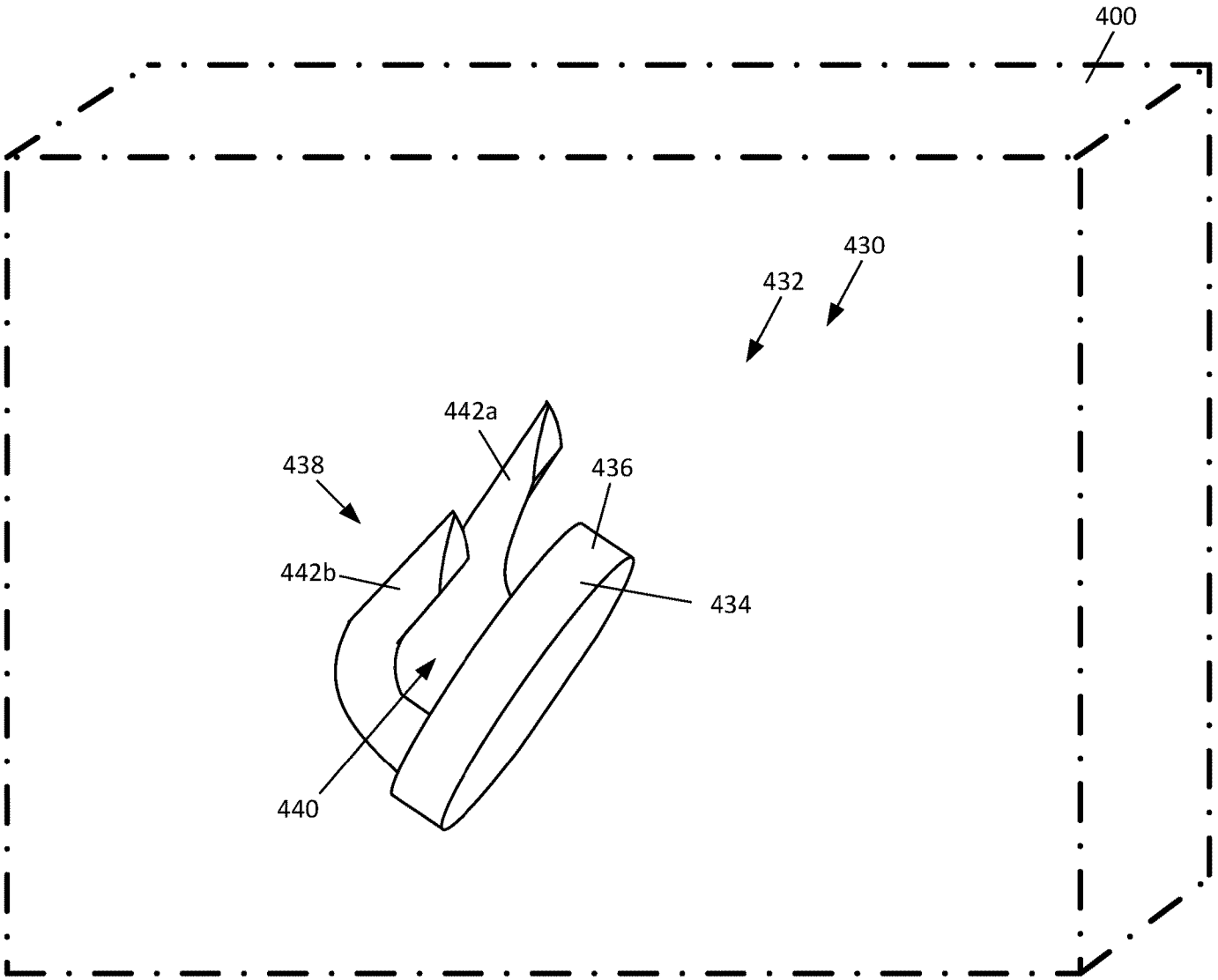
FIG. 15 is a rear perspective view of a digital model of the spray gun adapter.
Figure 16:
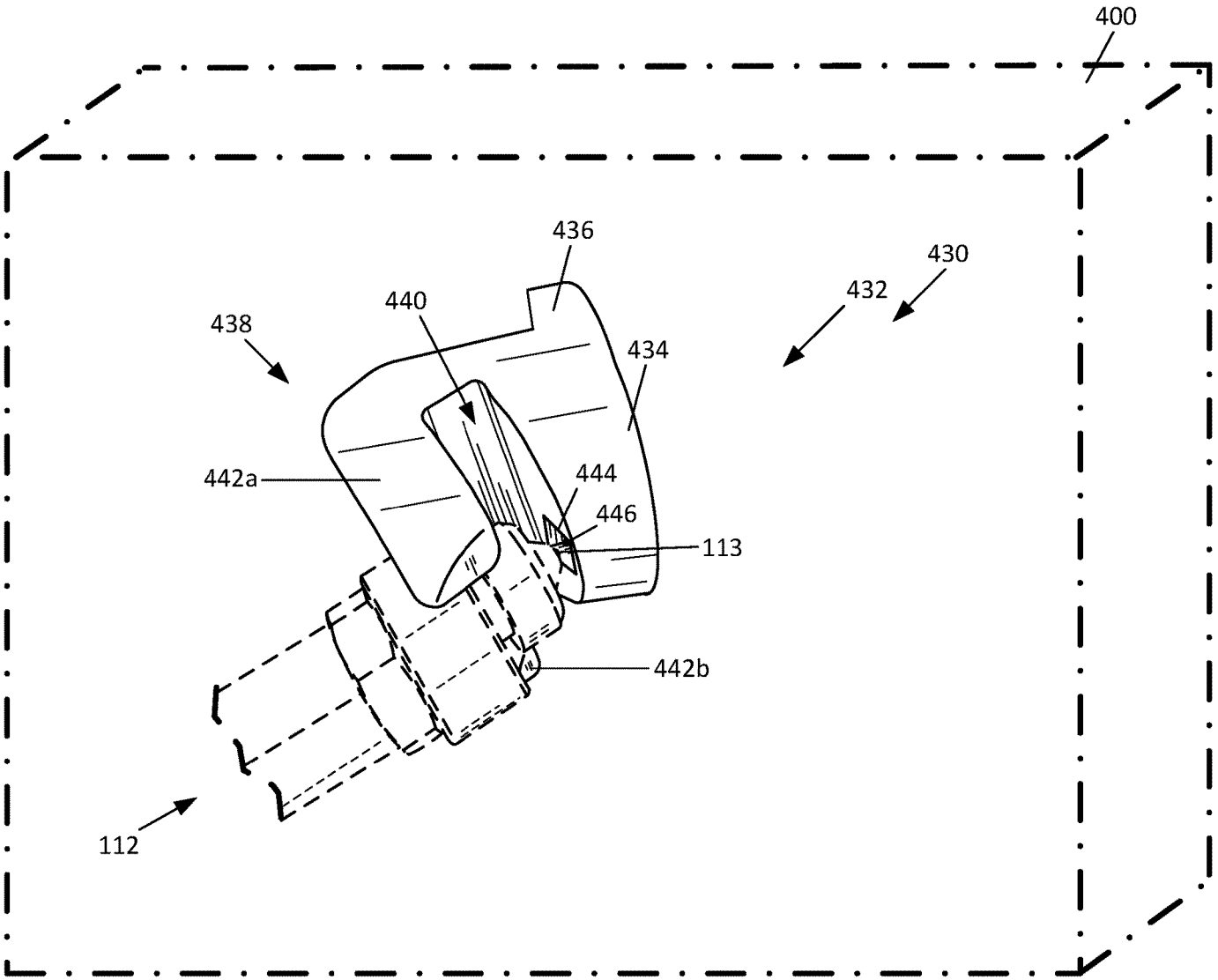
FIG. 16 is a side perspective view of the digital model of the spray gun adapter shown in FIG. 15.

FIGS. 15 and 16 are schematic diagrams illustrating an example digital model 430 of a spray gun adapter 432. The digital model 430 is shown in the model space 400 of the computing device 116, shown in FIG. 7. FIG. 15 shows a rear perspective view of the digital model 430 of the spray gun adapter 432, and FIG. 16 shows a side perspective view. An example spray gun 112 is also shown in broken lines in FIG. 16 for reference. FIGS. 15 and 16 are also examples of the operation 382 shown in FIG. 12.

In this example, the spray gun adapter 432 includes a body 434 including a base 436, a spray gun fastener 438, and a tool port 440. The spray gun fastener 438 includes fastening arms 442*a* and 442*b* in this example. The base 436 also includes a tip alignment receptacle 444 including a tip reference point 446 (shown in FIG. 16).

The spray gun adapter 432 is a portion of the alignment jig 108 and is configured to engage with the spray gun 112 of the spray machine 160 (FIG. 3). The spray gun adapter 432 is designed to fasten onto the spray gun 112.

In some embodiments, after an operator has identified the spray machine for which the alignment jig 108 is to be designed, the computing device 116 retrieves a digital model 430 of the spray gun adapter 432 from a model elements database 222. If a digital model 430 of the spray gun adapter 432 does not exist for the selected spray machine, a new model can be generated based on the configuration of the spray gun 112, such as using the interference data 394 (FIG. 13).

The body 434 includes a base 436 that has a size and shape similar to the second end 414 of the container portion of the container holder adapter 404, shown in FIG. 14.

The body 434 also includes a spray gun fastener 438 that is sized and shaped to engage with and fasten onto the spray gun 112. Accordingly, the particular configuration of the spray gun fastener 438 is designed based on the configuration of the spray gun 112. In this example, the spray gun fastener 438 includes a pair of spaced apart fastening arms 442*a* and 442*b*. The surfaces between the two fastening arms 442*a* are flat, and are spaced apart a precise distance to securely engage with corresponding surfaces of the spray gun 112. A rear surface at the intersection between the fastening arms 442*a* and 442*b* provides a backstop that engages with another corresponding surface of the spray gun 112.

The tool port 440 is a cutaway section of the body 434 arranged between the base 436 and the spray gun fastener 438. The tool port 440 provides a receptacle into which a tool can be inserted to interact with and adjust the spray gun 112, such as to rotate the nozzle to an appropriate orientation.

The base 436 also includes the tip alignment receptacle 444 and tip reference point 446, as shown in FIG. 16. The tip alignment receptacle 444 is configured to receive the tip 113 of the spray gun 112 to align the spray gun adapter 432 with the tip 113 of the spray gun 112. More particularly, the tip alignment receptacle 444 includes the tip reference point 446. The spray gun adapter 432 and tip alignment receptacle 444 are configured so that the tip 113 of the spray gun 112 fits precisely into the tip reference point 446. In some embodiments the tip alignment receptacle 444 is also shaped so that the tip 113 only fits into it if it is properly aligned.

Figure 17:
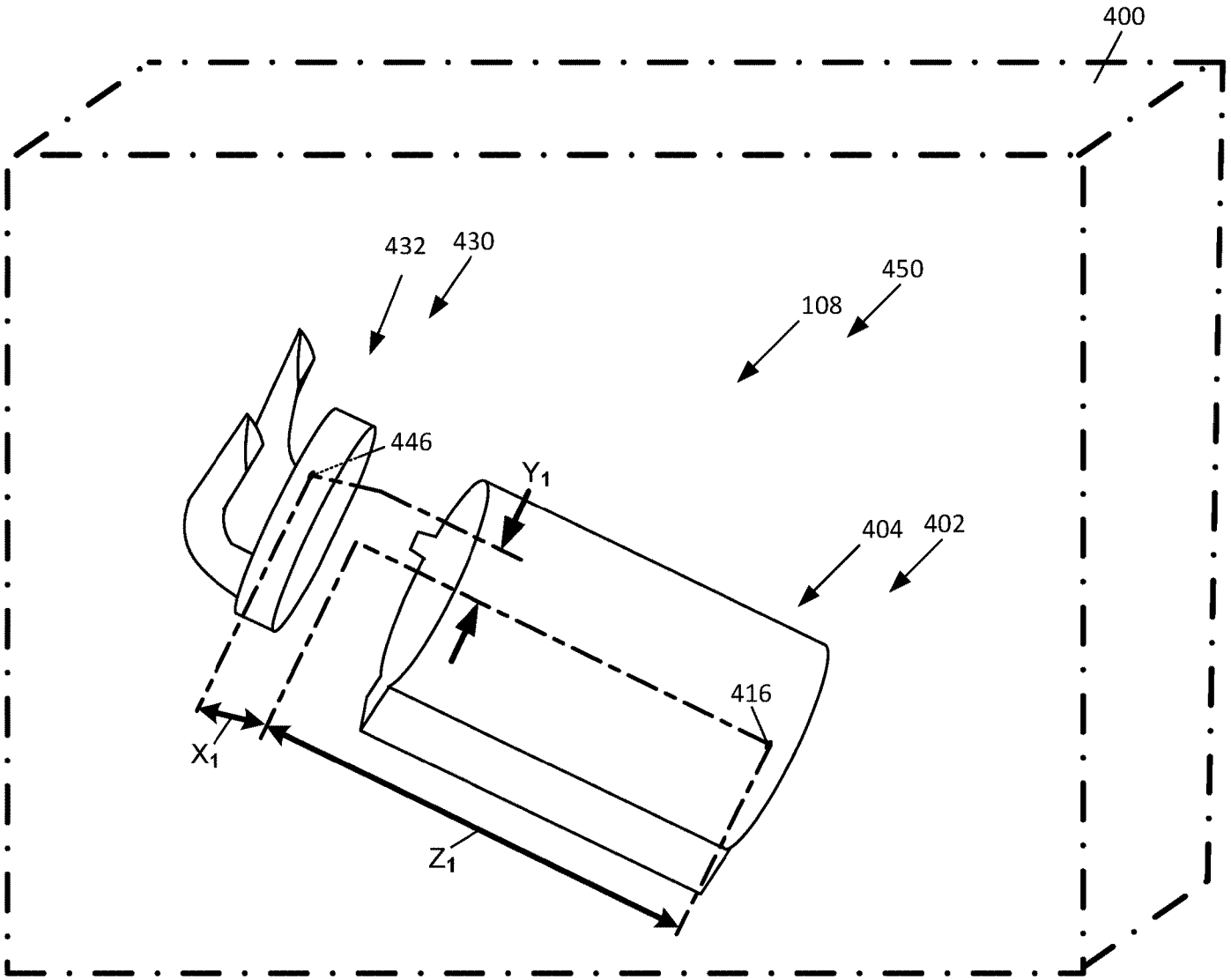
FIG. 17 is a schematic diagram illustrating the alignment of the digital model of the container holder adapter with the digital model of the spray gun adapter in the model space.

FIG. 17 is a schematic diagram illustrating the alignment of the digital model 402 of the container holder adapter 404 with the digital model 430 of the spray gun adapter 432 in the model space 400. In this example, the container holder adapter 404 includes the container reference point 416, and the spray gun adapter 432 includes the tip reference point 446.

Once the container holder adapter 404 and the spray gun adapter 432 have been generated by the computing device 116, they are then arranged within the model space 400 to be aligned with one another. Because the container holder adapter 404 and spray gun adapter 432 each have reference points 416 and 446 that correspond with the same reference points from which the spray gun alignment measurements were previously taken, the same alignment measurements 356 (FIG. 10) can be retrieved from the alignment database 220 and used for alignment of the container holder adapter 404 with the spray gun adapter 432. In the example shown in FIG. 10, the alignment measurements for Sprayer 1 with Coating 1 include a position offset of X1 cm, height of Y1 cm, and distance of Z1, and (not labeled in FIG. 17) an orientation pitch of P1, yaw of YA1, and roll of R1.

For example, the spray gun adapter 432 is arranged so that its tip reference point 446 is offset from the container reference point 416 of the container holder adapter 404 by X1 cm, has a height of Y1 cm, and has a distance of Z1 cm.

Similarly, the spray gun adapter 432 is arranged so that its orientation has a pitch P1, yaw YA1, and roll R1 (not labeled in FIG. 17).

Figure 18:
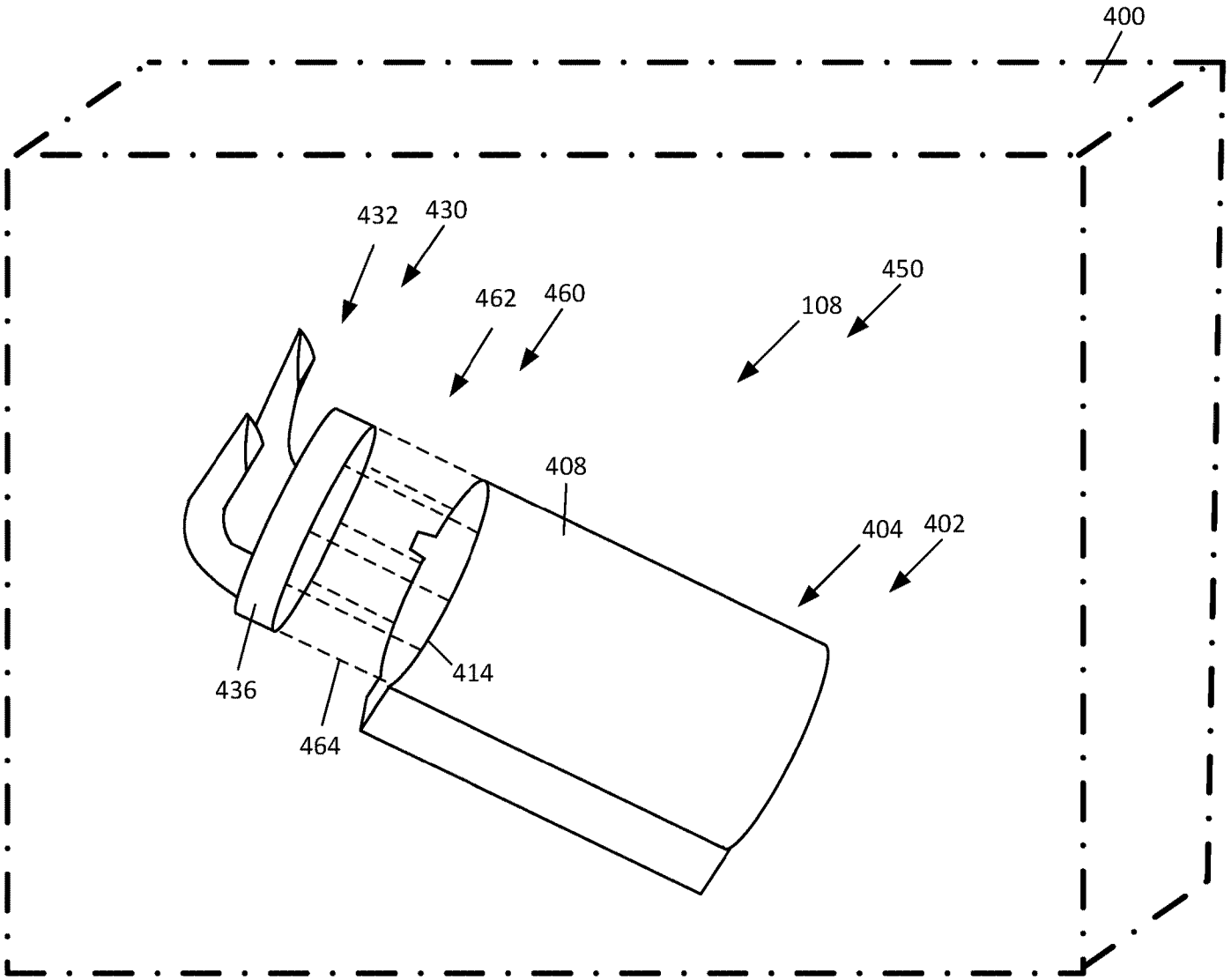
FIG. 18 is a schematic diagram illustrating the generation of a digital model of the linkage in the model space.

FIG. 18 is a schematic diagram illustrating the generation of a digital model 460 of the linkage 462 in the model space 400. FIG. 18 shows the digital model 402 of the container holder adapter 404 and the digital model 430 of the spray gun adapter 432. A surface of the linkage 462 is shown defined by connecting lines 464. FIG. 18 is also an example of the operation 384 shown in FIG. 12.

Once the container holder adapter 404 and spray gun adapter 432 have been properly aligned as illustrated and described with reference to FIG. 17, the linkage is then generated to connect the spray gun adapter 432 and the container holder adapter 404 in that predetermined alignment.

In some embodiments, the linkage 462 is generated by connecting a rear surface of the base 436 of the spray gun adapter 436 to the second end 414 of the container holder adapter 404. For example, perimeters of each surface are connected by defining a surface extending between the two perimeters, as illustrated by the connecting lines 464. The area inside of the connecting lines 464 and between the spray gun adapter 436 and the container holder adapter 404 can then be filled to generate the linkage 462.

In some embodiments the linkage 462 that has been generated is then analyzed using the interference data 394 from the model elements database 222. The interference data is used to check the area of the linkage 462 to determine whether it would interfere with any portion of the spray machine 160. If an interference is identified, then the digital model 460 of the linkage 462 is modified to eliminate the interference, such as by adding a notch, cutout, recess, or the like at the location of the interference.

The linkage 462 can be formed so that it is directly connected to and joins together the spray gun adapter 432 and the container holder adapter 404, such that the spray gun alignment jig 108 is one unitary piece. In other embodiments, the spray gun alignment jig 108 can be formed of multiple pieces, such as shown in FIG. 18.

Figure 19:
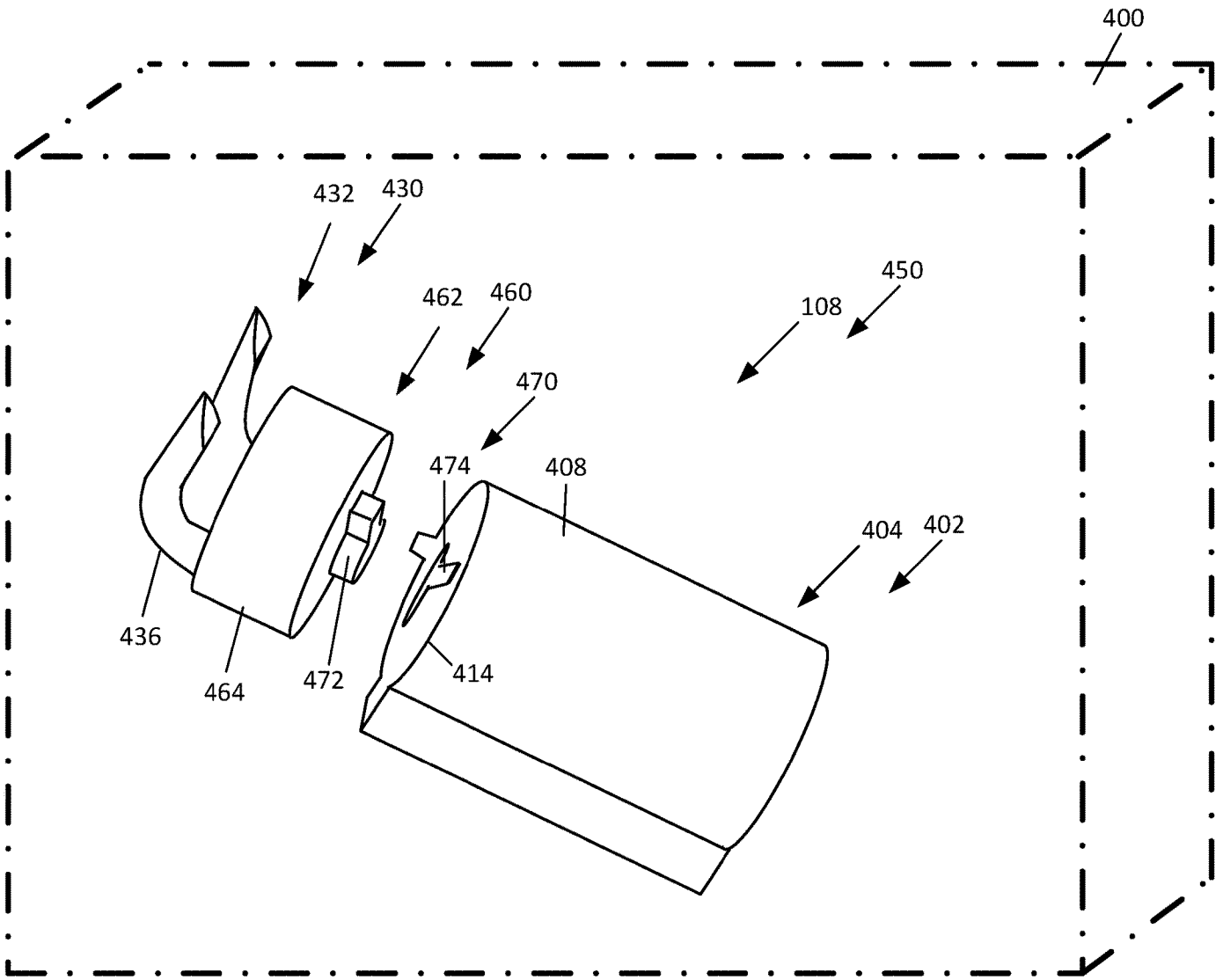
FIG. 19 is a schematic diagram further illustrating the generation of the digital model of the linkage in the model space.

FIG. 19 is a schematic diagram further illustrating the generation of the digital model 460 of the linkage 462 in the model space 400. In this example, the linkage 462 includes a releasable joint 470. In this example, the releasable joint 470 divides the spray gun alignment jig 108 into two pieces, and includes keyed features 472 and 474.

In some embodiments it is advantageous for the spray gun alignment jig 108 to be formed of two or more pieces. For example, a two-piece design allows the container holder adapter 404 to be inserted into the container holder 114 (FIG. 3) and the spray gun adapter 432 to be separately fastened to the spray gun 112. Then, the two parts can be brought together using the adjustable gun mount 166 (FIG. 3) and aligned while connecting the pieces at the releasable joint 470. Similarly, in some embodiments the releasable joint 470 makes it easier to remove the spray gun alignment jig 108 from the spray machine 160.

In some embodiments the releasable joint 470 includes keyed features 472 and 474. The feature 472 is a male feature arranged at one surface of the releasable joint 470, and the feature 474 is a female feature arranged in the other surface. The features are configured with corresponding shapes so that they can only fit together in one direction. In this way the alignment of the spray gun adapter 432 with the container holder adapter 404 is preserved.

Once the generation of the spray gun alignment jig 108 is completed, the digital model 450 can be saved in a computer-readable storage device. In some embodiments the digital model 450 is stored in a 3D CAD file format. In another possible embodiment, the digital model 450 is stored in a stereolithography (STL) file format particularly suited for transmitting the digital model 450 to the jig fabrication machine 118. The digital model 450 may also be stored in both or multiple file formats. In some embodiments the digital model 450 is stored as a jig model 358 in the alignment database 220 (FIG. 10).

Figure 20:
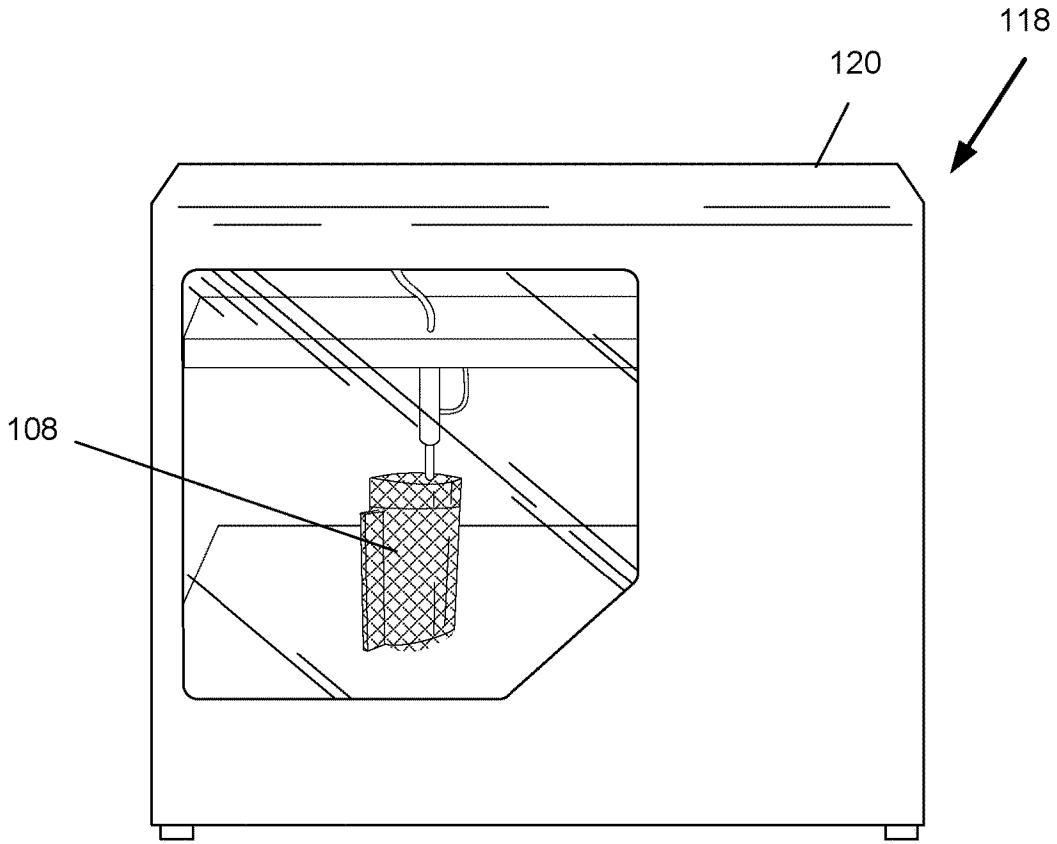
FIG. 20 is a front view of an example jig fabrication machine, and more specifically an example of a 3D printer for printing the spray gun alignment jig.

FIG. 20 is a front view of an example jig fabrication machine 118, and more specifically an example of a 3D printer 120 for printing the spray gun alignment jig 108.

After the spray gun alignment jig has been generated by the computing device 116, it can then be transmitted to the jig fabrication machine 118 to be fabricated. For example, the digital model 450 (FIG. 19) can be transmitted to the 3D printer 120.

To improve the efficiency of printing, a plurality of the spray gun alignment jigs 108 (of the same or different configurations) can be printed simultaneously.

A variety of jig fabrication machines 118 can be used, such as those previously discussed herein. Additionally, a wide variety of 3D printers are available, which can generate the spray gun alignment jig 108 using a variety of different materials. One example of a 3D printer is the Fusion3™ 3D printer, which can utilize printing filaments comprised of various different materials including Polyethylene Terephthalate Glycol-Modified (PETG), Polylactic Acid (PLA), and Acrylonitrile Butadiene Styrene (ABS).

Figure 21:
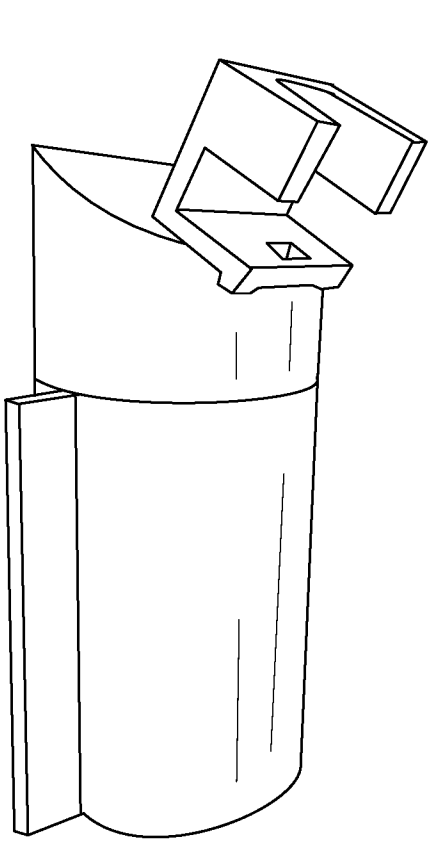
FIG. 21 is a perspective view of an example of the physical spray gun alignment jig.

FIG. 21 is a perspective view of an example of the physical spray gun alignment jig 108. Examples of the spray gun alignment jig 108 are described in detail herein with reference to the digital models 450 (including digital models 402, 430, and 460) in FIGS. 14-19.

Figure 22:
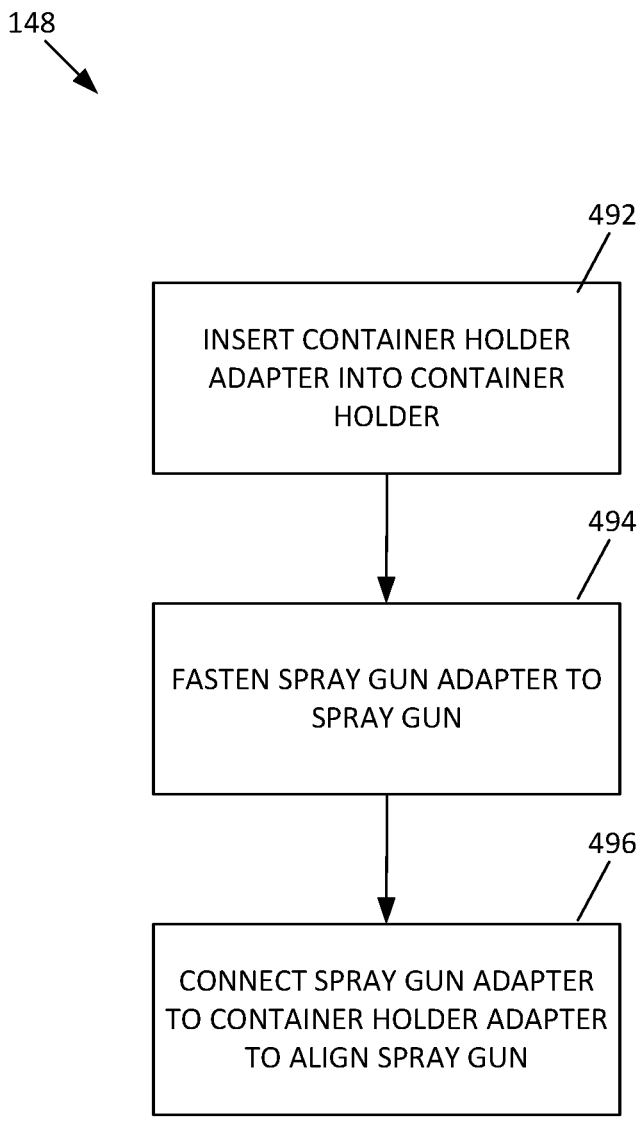
FIG. 22 is a flow chart illustrating an example method of aligning a spray gun using a spray gun alignment jig.

FIG. 22 is a flow chart illustrating an example method 148 of aligning a spray gun 112 using a spray gun alignment jig 108. In this example, the method 148 includes operations 492, 494, and 496.

The operation 492 is performed to insert a container holder adapter 404 into the container holder 114. An example of the operation 492 is illustrated in FIG. 23.

Figure 24:
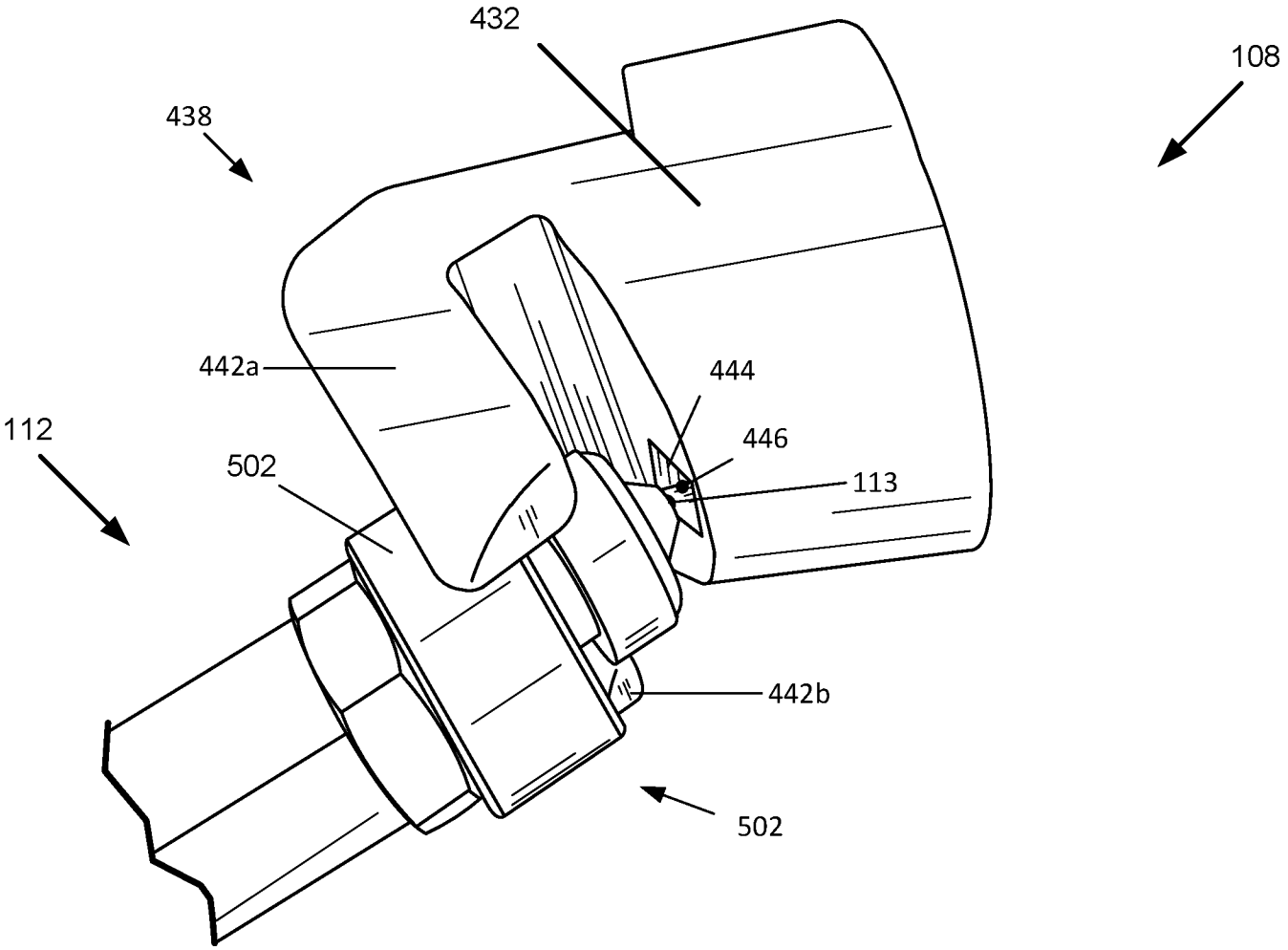
FIG. 24 is a perspective view illustrating a portion of an example spray gun, and further illustrating the spray gun adapter portion of the spray gun alignment jig.

The operation 494 is performed to fasten the spray gun adapter 432 to the spray gun 112. An example of the operation 494 is illustrated in FIG. 24.

Figure 25:
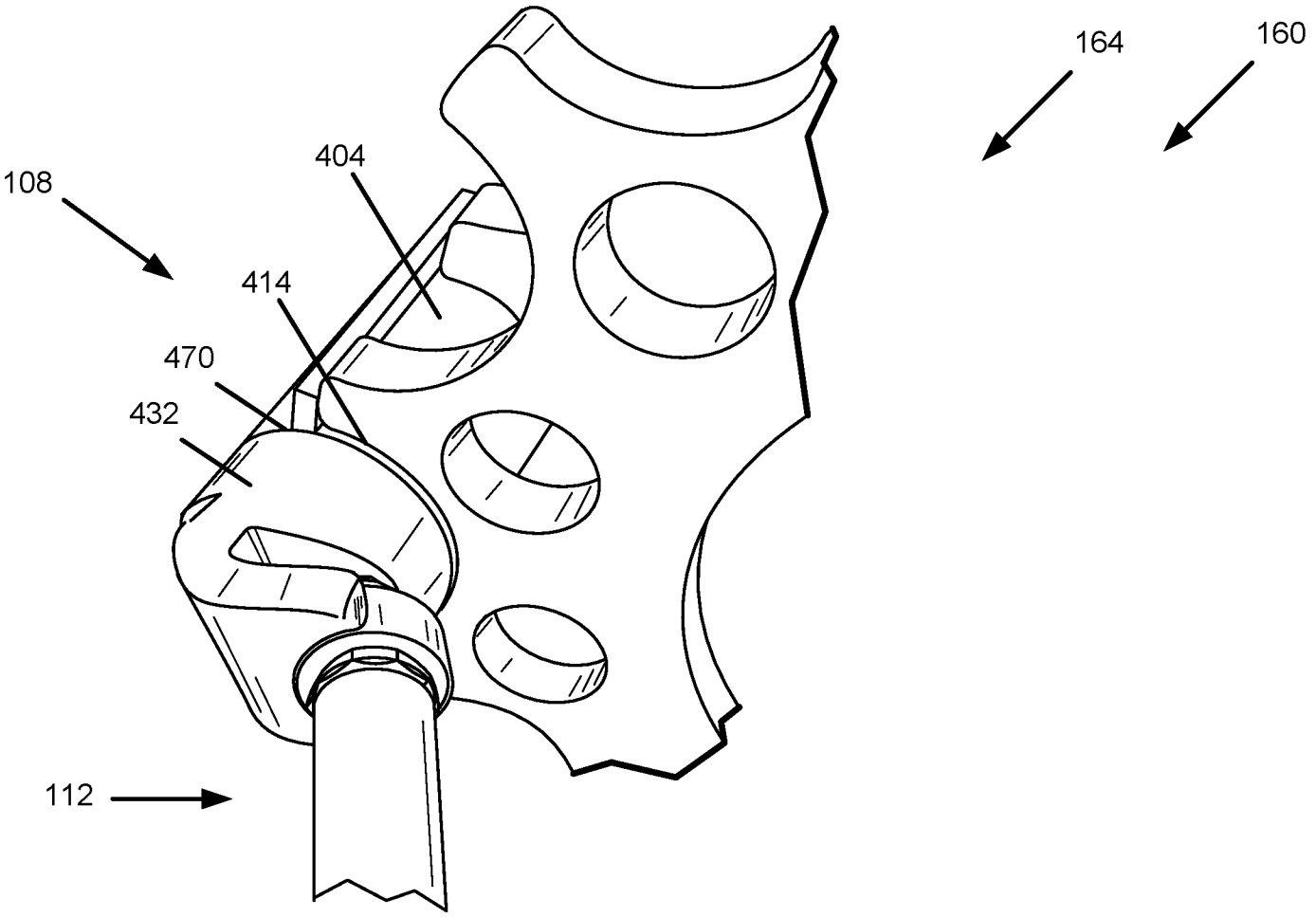
FIG. 25 is a perspective view of the spray gun alignment jig being used to align the spray gun of the container spray machine.

The operation 496 is performed to connect the spray gun adapter 432 to the container holder adapter 404 to align the spray gun 112 with the container holder 114 and the container C. In some embodiments, connecting the spray gun adapter 432 to the container holder adapter 404 involves fastening the releasable joint of the linkage 462, as illustrated and described with reference to FIG. 19. An example of the operation 496 is illustrated in FIG. 25.

Figure 23:
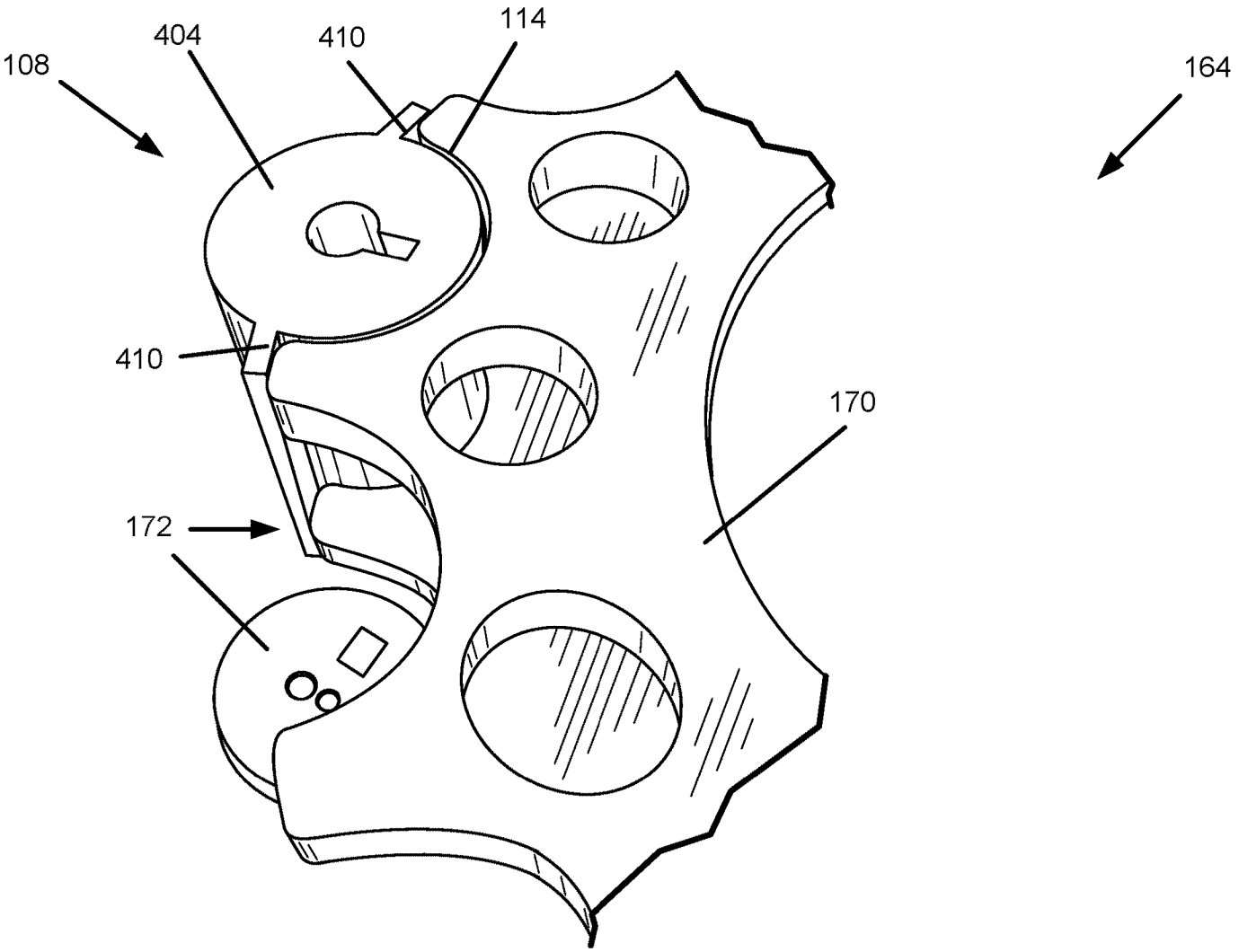
FIG. 23 is a perspective view illustrating a portion of an example container transporter of a spray machine, and further illustrating the container holder adapter portion of the spray gun alignment jig.

FIG. 23 is a perspective view illustrating a portion of an example container transporter 164 of a spray machine 160, and further illustrating the container holder adapter 404 portion of the spray gun alignment jig 108. In this example, the container transporter 164 includes the turret 170, the container holder 114, and the spinner 172.

The container holder adapter 404 portion of the spray gun alignment jig 108 is inserted into the container holder 114 at a position where a container C is to be sprayed by the spray gun 112. The container holder adapter 404 is positioned so that it is in the container holder 114, the first end of the container holder adapter 404 is against the spinner 172, and the orientation guides 410 are against the edges of the turret 170.

FIG. 24 is a perspective view illustrating a portion of an example spray gun 112, and further illustrating the spray gun adapter 432 portion of the spray gun alignment jig 108. In this example, the spray gun adapter 432 includes the spray gun fastener 438 including the fastening arms 442*a* and 442*b*, the tip alignment receptacle 444, and the tip reference point 446. The spray gun 112 includes the tip 113 and alignment surfaces 502.

The spray gun adapter 432 portion of the spray gun alignment jig 108 is fastened onto the spray gun 112. The inwardly facing surfaces of the fastening arms 442*a* and 442*b* are secured to the alignment surfaces 502, and the tip 113 is inserted into the tip alignment receptacle 444, such that the tip 113 is positioned at the tip reference point 446.

FIG. 25 is a perspective view of the spray gun alignment jig 108 being used to align the spray gun 112 with the container holder 114 of the container spray machine 160.

With the container holder adapter 404 inserted into the container holder 114 and the spray gun adapter 432 is fastened to the spray gun 112, the adjustable gun mount 166 (FIG. 3) is adjusted to move the spray gun 112 and spray gun adapter 432 toward each other. The spray gun adapter 432 and container holder adapter 404 portions are then joined together using the releasable joint. Once connected, the spray gun 112 is properly aligned with the container holder adapter 404 and the alignment can be locked in place using the adjustable gun mount 166. The spray gun alignment jig 108 is then removed from the spray machine, and the spray machine is ready for use.

The two-part configuration of the spray gun alignment jig 108 makes it easier to remove the spray gun alignment jig 108 from the spray machine 160. For example, the container holder adapter 432 can first be separated from the spray gun adapter 432 at the releasable joint 470 while the parts are still coupled to the respective container holder 114 and spray gun 112. The container holder adapter 432 can then be removed from the container holder 114, and the spray gun adapter 432 can then be removed from the spray gun 112.

The spray machine 160 has an adjustable gun mount 166 (FIG. 3) that allows the precise position of the spray gun 112 to be locked in place and properly aligned using the spray gun alignment jig 108, but also includes a pivotable joint that allows the spray gun 112 to be pivoted away from the container holder 114 into an open position that allows the operator to access both the spray gun 112 and the container holder 114. The pivotable joint can then be returned to and locked into place in an operating position such that the precise alignment of the spray gun 112 with respect to the container holder 114 is preserved.

In some embodiments, the spray gun alignment system 100 described herein ensures standardization of spray setup. The spray gun alignment can be easily accomplished by spray machine operators, and requires less training and practice.

The spray gun alignment system 100 provides repeatable spray setups across every spray machine regardless of operator, and reduces the chance for errors to be made. It also minimizes downtime due to coating changeovers, and significantly reduces spoilage and overspray due to poor spray setup.

Although the present disclosure makes use of several specific examples of containers that can be coated by the spray machine 160, the system 100 is not limited to applying coatings to only these examples. A wide variety of articles may be sprayed using the system 100. Articles may be made of a variety of materials including metal or glass. Examples of such articles include beer or soda bottles, wine bottles, liquor bottles, pharmaceutical containers, cosmetic containers, aerosol cans, paint containers, perfume containers, candle holders, dishware (e.g., plates, stemware, mugs, etc.), vases, glass tile, glass mosaics, shaped components for mirror application, window glass, and molded components for various applications (e.g., automotive, aviation, etc.). Some articles may also be exterior coated for aesthetic purposes.

The spray gun alignment system 100 can be manufactured for use with any spray gun setup and any spray coating. Suitable spray coating chemistries may include, for example, sprayable water-borne coating compositions (which may include some organic solvent), sprayable organic-solvent-based coating compositions (which may include a de minimus amount of water such as, e.g., 2 weight percent ("wt-%") or less, if any), and sprayable powder coating compositions. The coatings may include any suitable combination of one or more film-forming components and other coating adjuvants. Such film-forming components may include, for example, latex emulsions, organic solution polymerized acrylic polymers, polyester polymers, polyether polymers, polyether-acrylate polymers, polyester-acrylate polymers, polyolefin polymers, and copolymers and combinations thereof.

In some embodiments, the spray gun alignment system 100 (and the spray gun alignment jig 108) may be adapted to facilitate interior spray coating of food or beverage cans, or other packaging containers, using any one of the following inside spray products:

the INNOVEL HPS series of water-borne acrylic beverage can inside spray products from PPG, which is described in manufacturer literature as having a solids contents of 20±1 wt-% (15 minutes at 200° C.), a viscosity of about 20±2 seconds (Ford number 4 cup at 25° C.), and a density of 1.02±1 (20° C.);

the INNOVEL MAX internal spray lacquer products from PPG for aluminum aerosol cans;

the INNOVEL VCL clear internal spray product from PPG for aluminum bottles, aerosols and tubes;

the NUTRISHEILD SOLISTA non-BPA internal spray products from PPG for D&I (drawn and ironed) food cans;

the PPG6100 and PPG 6150 internal gold and aluminized spray coating products from PPG for D&I food cans;

the AQUALURE G1 50 beverage can inside spray product from Akzo-Nobel, which is described by manufacturer literature as a water-borne modified acrylic BPA-NI (bisphenol A non-intent) coating composition typically having the following properties 18-19% solids, target applied film weight of (330 ml beverage can) 3 grams per square meter or "gsm" (typically 110 mg per can), total volatile organic content ("VOC") of about 14.2 wt-% (19 wt-% nvm variant), and a viscosity of 32-47 seconds (ISO 4 Cup at 25° C.);

the acrylic and polyether-acrylic beverage can inside spray products sold under the VALPURE line of non-BPA products by The Sherwin-Williams Company;

the polyether-acrylic and polyester two-piece D&I food can inside spray products sold under the VALPURE line of non-BPA products by The Sherwin-Williams Company;

the CANVERA 1110 beverage can inside spray product from Dow, which is described in manufacturer literature as an aqueous acid-modified polyolefin dispersion that can be formulated into a sprayable coating composition having 20±1 wt-% solids and a viscosity of 18-40 seconds (Ford number 4 cup at 21° C.); and the CANVERA 3110 food can internal spray product from Dow, which is described in manufacturer literature as an aqueous acid-modified polyolefin dispersion that be formulated into a sprayable coating composition having 18% to 40% solids (e.g., a coating composition having about 31% solids and viscosity of 23±2 seconds (Ford number 4 cup at 21° C.).

In some embodiments the spray gun alignment jig 108 includes indicia that correlates it to a particular spray coating. For example, when a spray gun alignment jig 108 is configured to align the spray machine 160 for spraying a particular spray coating, the spray gun alignment jig 108 includes indicia that can be used to identify the particular spray coating. Examples of the coatings are described in the list above and throughout this specification. One example of a suitable indicia is a name of the spray coating (which can be printed on, engraved into, or otherwise formed on a surface of the spray gun alignment jig 108, or printed onto a label that is then applied to the surface of the spray gun alignment jig 108). Other examples of indicia include a human-readable code or a machine-readable code (e.g., barcode or QR code) associated with the spray coating. Another example of a suitable indicia is a color of the spray gun alignment jig 108, or a portion thereof. For example, the spray gun alignment jig 108 can be made with a material having a selected color, and the color is associated with the spray coating.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A spray gun alignment jig for aligning a spray gun with a container holder of a container spray machine, the container spray machine configured to spray a liquid coating, the spray gun of the container spray machine having an adjustable position and orientation, the spray gun alignment jig comprising:

a container holder adapter that is sized and configured to fit within a container holder of the container spray machine;

a spray gun adapter that engages with the spray gun; and a linkage that connects the spray gun adapter and the container holder adapter in a predetermined alignment.

2. The spray gun alignment jig of claim 1, wherein the linkage includes a releasable joint that is releasable to separate the container holder adapter from the spray gun adapter.

3. The spray gun alignment jig of claim 1, wherein the container holder adapter further comprises an orientation guide that causes the container holder adapter to fit within the container holder in a particular orientation.

4. The spray gun alignment jig of claim 1, wherein the container holder is part of a container spinner of a container transporter of the container spray machine.

5. The spray gun alignment jig of claim 1, wherein the spray gun adapter includes a tip alignment receptacle that receives a tip of the spray gun to align the spray gun adapter with the tip of the spray gun.

6. The spray gun alignment jig of claim 1, wherein the predetermined alignment includes a predetermined position and a predetermined orientation.

7. The spray gun alignment jig of claim 6, wherein the predetermined position comprises:

a forward/backward position;

a left/right position; and an up/down position.

8. The spray gun alignment jig of claim 6, wherein the predetermined orientation comprises:

a pitch;

a roll; and a yaw.

9. The spray gun alignment jig of claim 1, wherein the predetermined alignment causes the spray gun to spray an interior coating that conforms to at least one interior coating criterion.

10. The spray gun alignment jig of claim 9, wherein the at least one interior coating criterion is selected from: an amount of an interior surface that is coated, a thickness of the interior coating, an amount of interior surface that is exposed, and an electrical resistance of the interior coating.

11. The spray gun alignment jig of claim 1, wherein the spray gun alignment jig is configured to align the spray gun with a container in a predetermined orientation selected for applying an interior coating to the container, the interior coating being one of: a sprayable water-borne coating composition, and a sprayable organic-solvent-based coating composition.

12. The spray gun alignment jig of claim 11, wherein the interior coating further comprises one or more film-forming components selected from: latex emulsions, organic solution polymerized acrylic polymers, polyester polymers, polyether polymers, polyether-acrylate polymers, polyester-acrylate polymers, polyolefin polymers, and copolymers and combinations thereof.

13. The spray gun alignment jig of claim 1, wherein the spray gun alignment jig is configured to align the spray gun based on at least one coating characteristic selected from a viscosity of the coating, a rheology of the coating, and a draping of the coating.

14. The spray gun alignment jig of claim 1, wherein the spray gun alignment jig is configured to align the spray gun with the container holder to spray an aqueous beverage container inside spray product.

15. The spray gun alignment jig of claim 1, wherein the spray gun adapter includes a body including a base and a spray gun fastener.

16. The spray gun alignment jig of claim 15, wherein the spray gun fastener includes fastening arms.

17. The spray gun alignment jig of claim 16, wherein the body of the spray gun adapter further comprises a tool port.

18. The spray gun alignment jig of claim 17, wherein the tool port is arranged between the base and the spray gun fastener.

19. The spray gun alignment jig of claim 18, wherein the tool port provides a receptacle into which a tool can be inserted to interact with and adjust the spray gun when the spray gun is engaged with the spray gun adapter.

20. The spray gun alignment jig of claim 18, wherein the base of the spray gun adapter includes a tip alignment receptacle adjacent to the tool port that is configured to receive a tip of the spray gun to align the spray gun adapter with the tip of the spray gun.

21. The spray gun alignment jig of claim 1, wherein the container holder adapter further comprises a container portion.

22. The spray gun alignment jig of claim 21, body, a first end, and a second end, wherein the first end engages a base of the container holder wherein the container portion comprises a body, a first end, and a second end, wherein the first end of the container portion engages a base of the container holder and the body of the container portion extends from the base of the container holder to an opening of the container holder where the second end of the container portion engages with the linkage.

23. The spray gun alignment jig of claim 1, wherein the spray gun alignment jig is configured to be removed from the container spray machine prior to use of the container spray machine.

24. The spray gun alignment jig of claim 1, wherein the spray gun adapter is configured to guide adjustment of the spray gun from a first alignment to a second alignment, wherein the second alignment is defined by:

the spray gun alignment jig being inserted into the container holder adapter;

the linkage being connected between the spray gun adapter and the container holder adapter; and the spray gun being engaged with the spray gun adapter.

25. The spray gun alignment jig of claim 1, wherein the spray gun alignment jig is configured as one unitary piece.

* * * * *